US007798161B2

(12) United States Patent
Ma

(10) Patent No.: US 7,798,161 B2
(45) Date of Patent: Sep. 21, 2010

(54) SHADE STRUCTURES SUCH AS UMBRELLAS

(75) Inventor: Oliver Joen-an Ma, 29 W. Wisteria, Arcadia, CA (US) 91007

(73) Assignee: Oliver Joen-an Ma, Arcadia, CA (US)

( * ) Notice: Subject to any disclaimer, the term of this patent is extended or adjusted under 35 U.S.C. 154(b) by 353 days.

(21) Appl. No.: 11/850,628

(22) Filed: Sep. 5, 2007

(65) Prior Publication Data

US 2008/0066791 A1 Mar. 20, 2008

Related U.S. Application Data

(60) Provisional application No. 60/842,472, filed on Sep. 5, 2006.

(51) Int. Cl.
*A45B 25/06* (2006.01)
*A45B 19/08* (2006.01)

(52) U.S. Cl. ..... 135/28; 135/15.1; 135/20.3; 135/25.4

(58) Field of Classification Search ..... 135/15.1, 135/16, 20.1, 20.3, 25.33, 25.4, 28, 38, 39, 135/41

See application file for complete search history.

(56) References Cited

U.S. PATENT DOCUMENTS

| | | | |
|---|---|---|---|
| 229,685 | A | 7/1880 | Ege |
| 521,222 | A | 6/1894 | Schof et al. |
| 620,815 | A | 3/1899 | Warren |
| 776,352 | A | 11/1904 | Rogers |
| 928,169 | A | 7/1909 | Bardon |
| 1,001,076 | A | 8/1911 | Redford |
| 1,207,649 | A | 12/1916 | South |
| D56,043 | S | 8/1920 | Weinberg et al. |
| 1,712,430 | A | 5/1929 | Giszczynski |
| 1,908,453 | A | 5/1933 | Schmidt |
| 2,168,188 | A | 8/1939 | Bernhard |
| 2,185,466 | A | 1/1940 | Jostes |
| 2,474,516 | A | 6/1949 | Daniel |
| 2,507,919 | A | 5/1950 | Mazzeo |
| 2,661,752 | A | 12/1953 | Kampf et al. |

(Continued)

FOREIGN PATENT DOCUMENTS

| | | |
|---|---|---|
| AU | 702 172 B2 | 2/1999 |

(Continued)

OTHER PUBLICATIONS

International Search Report and Written Opinion in corresponding PCT Application No. PCT/US2007/077668, mailed Jan. 29, 2008.

(Continued)

*Primary Examiner*—David Dunn
*Assistant Examiner*—Danielle Jackson
(74) *Attorney, Agent, or Firm*—Knobbe, Martens, Olson & Bear, LLP

(57) ABSTRACT

This invention is concerned with shade structures, such as umbrellas, particularly large free-standing umbrellas, which have variable geometry. In preferred embodiments, the invention provides umbrellas that comprise multiple sets of ribs supporting a canopy structure and having a mechanism associated with each set of ribs for influencing the angle or elevation of the rib sets.

25 Claims, 15 Drawing Sheets

U.S. PATENT DOCUMENTS

| | | | | |
|---|---|---|---|---|
| 2,705,967 | A | 4/1955 | Zimmermann et al. | |
| 2,860,647 | A | 11/1958 | Negri | |
| 2,906,277 | A | 9/1959 | Militano | |
| 3,016,910 | A | 1/1962 | Rosenkaimer | |
| 3,672,381 | A | 6/1972 | Kida et al. | |
| 3,828,805 | A | 8/1974 | Thur | |
| 4,030,514 | A | 6/1977 | Schultes | |
| 4,080,976 | A | 3/1978 | Hirai | |
| 4,144,900 | A | 3/1979 | Kinski | |
| 4,474,200 | A | 10/1984 | Kida | |
| 4,474,201 | A | 10/1984 | Kida | |
| 4,697,606 | A | 10/1987 | Ma | |
| 4,763,679 | A | 8/1988 | Lerch | |
| 5,036,872 | A | 8/1991 | Huang | |
| 5,329,953 | A | 7/1994 | Becher | |
| 5,483,985 | A | 1/1996 | Yu | |
| 5,564,453 | A | 10/1996 | Steiner | |
| 5,617,888 | A * | 4/1997 | Wu | 135/20.3 |
| 5,640,984 | A | 6/1997 | Dubunsky | |
| 5,655,557 | A | 8/1997 | Martin | |
| 5,740,824 | A | 4/1998 | Tang | |
| 5,752,534 | A | 5/1998 | Becher | |
| 5,842,493 | A | 12/1998 | Yakubisin | |
| 5,884,645 | A | 3/1999 | Chen et al. | |
| 6,039,063 | A | 3/2000 | Lin et al. | |
| 6,076,540 | A | 6/2000 | You | |
| 6,082,383 | A | 7/2000 | Wilson | |
| 6,095,169 | A | 8/2000 | Lin et al. | |
| 6,196,244 | B1 | 3/2001 | Haddad et al. | |
| 6,311,707 | B1 | 11/2001 | Wu et al. | |
| 6,374,840 | B1 | 4/2002 | Ma | |
| 6,386,214 | B1 | 5/2002 | Clarke | |
| 6,390,107 | B1 | 5/2002 | Lin et al. | |
| 6,626,199 | B2 | 9/2003 | Lin et al. | |
| D497,478 | S | 10/2004 | Clarke | |
| 7,401,618 | B2 * | 7/2008 | Caldwell | 135/33.7 |
| 2003/0005952 | A1 | 1/2003 | Chen | |
| 2003/0098050 | A1 | 5/2003 | Lee | |
| 2004/0035452 | A1 | 2/2004 | Ma | |
| 2004/0055628 | A1 | 3/2004 | Yu | |
| 2004/0182429 | A1 | 9/2004 | Chen | |
| 2005/0028853 | A1 | 2/2005 | Houtan | |
| 2005/0045217 | A1 | 3/2005 | Clarke | |
| 2006/0090784 | A1 | 5/2006 | Ma | |
| 2006/0151018 | A1 | 7/2006 | Wilson | |
| 2008/0066793 | A1 | 3/2008 | Ma | |

FOREIGN PATENT DOCUMENTS

| | | | |
|---|---|---|---|
| DE | 580503 | | 7/1933 |
| DE | 203 06 406 | U1 | 7/1994 |
| DE | 20 2005 011579 | U1 | 7/2006 |
| EP | 0 392 989 | | 3/1990 |
| EP | 1 654 952 | | 5/2006 |
| EP | 1654952 | A1 | 5/2006 |
| FR | 2 554 490 | A | 5/1985 |
| GB | 22218 | A | 9/1910 |
| NL | 9 500 219 | A | 9/1996 |
| NL | 9500219 | A * | 9/1996 |
| WO | WO 2006/076270 | | 7/2006 |
| WO | WO 2007/018492 | A | 2/2007 |

OTHER PUBLICATIONS

International Search Report and Written Opinion in co-pending PCT Application No. PCT/US2007/077673, mailed Jan. 29, 2008.

U.S. Appl. No. 11/850,640, filed Sep. 5, 2007.

Preliminary Report on the Patentability of Corresponding PCT Application No. PCT/US2007/077668, mailed Mar. 19, 2009, 8 pages.

Preliminary Report on Patentability of Corresponding PCT Application No. PCT/US2007/077673, mailed Mar. 19, 2009, 7 pages.

European Search Report dated Mar. 20, 2006 regarding Application No. EP 05255342.7-2313.

* cited by examiner

SHADE STRUCTURES SUCH AS UMBRELLAS

This application claims the benefit of U.S. Provisional Application No. 60/842,472, filed Sep. 5, 2006, the entirety of which is hereby incorporated herein by reference.

BACKGROUND

1. Field

This invention is concerned with shade structures, such as umbrellas, particularly large free-standing umbrellas, which have variable geometry. In preferred embodiments, the invention provides umbrellas that comprise multiple sets of ribs supporting a canopy structure and having a mechanism associated with each set of ribs for influencing the angle or elevation of the rib sets.

2. Description of the Related Art

Shade structures, and in particular umbrellas, have long been known that comprise a pole supporting a set of ribs to which is attached a fabric canopy and having a mechanism mounted to the pole that operates to extend or retract the ribs and thereby raise or lower the canopy.

As use of outdoor restaurants, patios and gardens and the like becomes more popular, so there is an increasing demand for shade structures that are more flexible, visually appealing or offer enhanced features or ease of operation.

SUMMARY

According to one embodiment the invention there are provided shade structures, preferably umbrellas, comprising a pole assembly having an upper hub from which extends in generally radial directions a plurality of ribs for supporting a canopy structure. The ribs form a plurality of rib sets. In one embodiment of the invention, the shade structure comprises a plurality of mechanisms associated with the pole assembly that affect the angle of the ribs with respect to the pole assembly. Preferably, at least one of the mechanisms is adapted to operate at least one rib set independently of or to a different extent from at least another rib set. In a preferred embodiment, the pole assembly comprises a main upright pole having the mechanisms attached thereto.

In a preferred embodiment of the invention, the pole comprises a plurality of channels in its outer surface extending generally parallel to the axis of the pole. The mechanisms preferably comprise a handle mounted to move up and down the pole and connected to an actuator in the respective channel to operate a respective rib set. More preferably, the invention provides an umbrella having two such mechanisms and two such channels, with one mechanism per channel. In a preferred embodiment, a first mechanism is coupled to raise and lower an upper hub and a second mechanism is coupled to raise and lower a lower hub.

Another embodiment of the invention provides an umbrella, comprising a support pole assembly comprising a lower pole and an upper pole translatable relative to the lower pole, the support pole further comprising an outer surface and an elongate channel recessed in the outer surface. The umbrella further comprises a canopy support frame comprising a first hub coupled with the upper pole, a second hub disposed beneath the first hub, and a plurality of ribs, each rib having a first end coupled with the first hub and a second end disposed away from the first hub, the canopy support frame having an open position in which the second end of each of the ribs is disposed away from the support pole assembly at a first elevation. A canopy is coupled with the canopy support frame and movable therewith. The umbrella also comprises an actuating handle and an elongate member disposed in said elongate channel, the elongate member being coupled with the first hub and with the actuating handle, wherein after the canopy has been moved to the open position, the actuating handle can be movable to move the second hub to raise the second end of the ribs to a second elevation that is higher the first elevation.

Another embodiment of the invention provides an umbrella, comprising a support pole assembly comprising an outer surface and an elongate channel recessed in the outer surface and a canopy support frame comprising a first hub coupled with the upper pole and with a plurality of ribs and a second hub disposed beneath the first hub and coupled with the plurality of ribs. The umbrella further comprises a canopy coupled with the canopy support frame and movable therewith, an actuating handle and an elongate member disposed in said elongate channel, the elongate member being coupled with the first hub, wherein after the canopy has been moved to an open position, the actuating handle can be movable to move the second hub to alter the configuration of the canopy.

Another embodiment of the invention provides an umbrella comprising a support pole; a first hub attached to the support pole and having a plurality of ribs extending from the hub, the ribs supporting a canopy and being movable from or stowed position in which the canopy is substantially closed to an extended position in which the canopy is substantially open; at least one additional hub extending around the support pole at a location below the first hub, the additional hub comprising: a first hub component having a plurality of ribs extending therefrom; a second hub component having a plurality of ribs extending therefrom; first and second hub components being movable with respect to each other from a position in which they are nested or embedded together to another position in which they are separated; an actuating handle; and an elongate member disposed in said elongate channel, the elongate member being coupled with the first hub; wherein the actuating handle can be movable to move the first hub component of the second hub to alter the configuration canopy.

The ribs of the first and second hub components may be connected to their respective hub components by connectors that permit the ribs to pivot about a pivot point and where the pivot points of the ribs of the front hub component and second hub component be in substantially the same place where the hub components are nested or embedded together.

Each of the first and second hub components may have at least one projection element and at least one recess, so that the first and second hub components can be nested or embedded together by interaction of the respective projection(s) and recess(es).

The first hub component may be in the upper position with respect to the second hub component when the umbrella is erected and the first hub component has fewer ribs than the second hub component. For example, the first hub component may have two ribs and the second hub component may have four ribs.

Another embodiment of the invention provides an umbrella comprising a pole having an upper hub having a plurality of ribs extending therefrom to support a fabric canopy thereon the pole having a longitudinal axis and at least two channels formed in the outer surface thereof extending substantially parallel to that axis, an actuator slideably movable in each channel to effectuate a change in the configuration of the canopy; whereby raising a first of the actuator in its respective channel causes the canopy to open; and raising a second of the actuators in its respective channel causes the canopy to change its shape. Raising and lowering the first actuator may cause the umbrella canopy to open and close and raising and lowering the second actuator may cause every other rib to be raised with respect to adjacent ribs.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION

Figure 1:
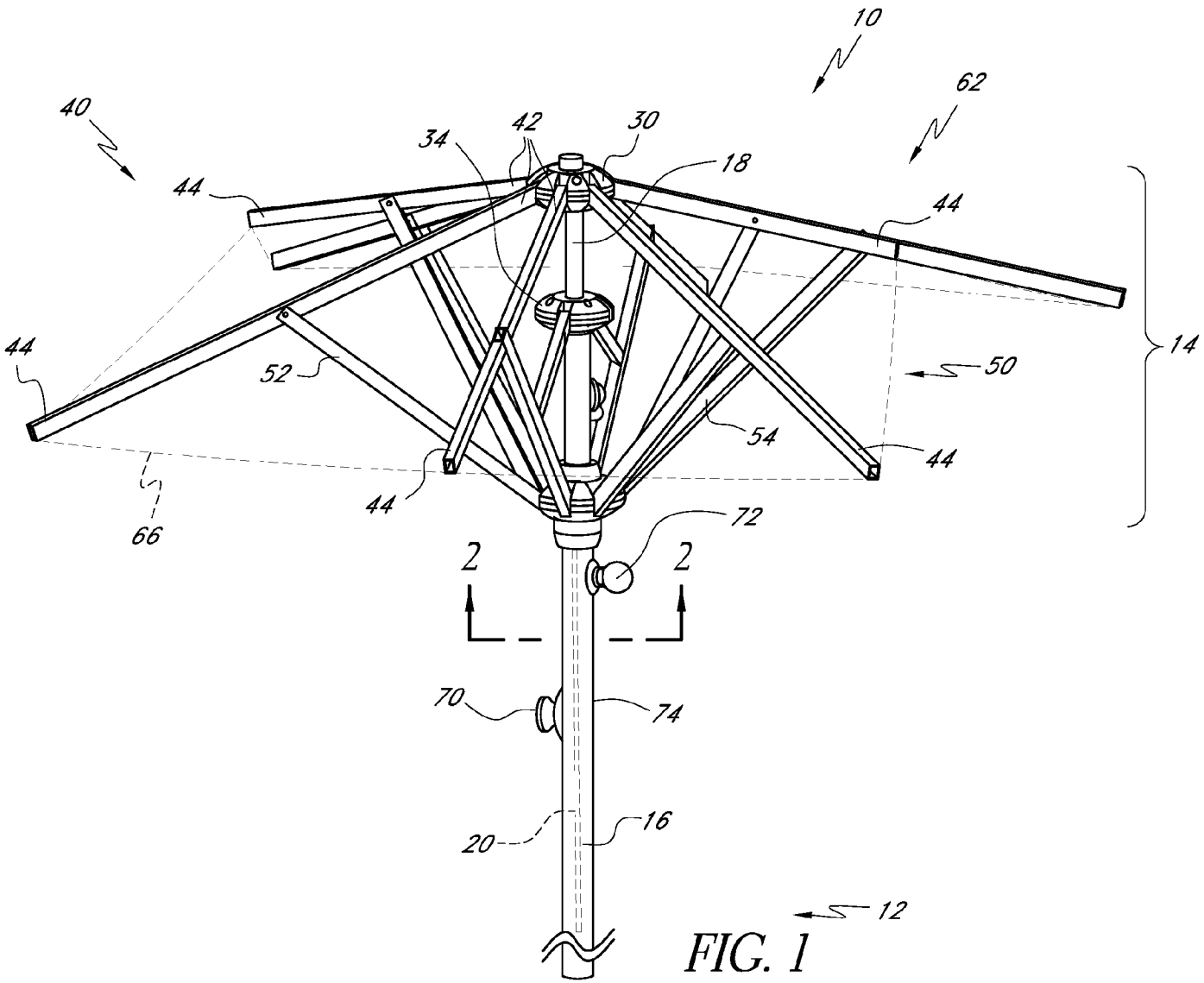
FIG. 1 is a perspective view of an umbrella according to the invention.

Referring now to the drawings, which illustrate some preferred embodiments of the present invention, and are not for limiting the same, a uniquely configured umbrella 10 is provided. As will be shown with reference to the drawings, a preferred embodiment of the umbrella 10 can be adjusted between a closed position, an open position, and an extended position utilizing innovative mechanisms and techniques which are discussed in greater detail below.

According to an implementation of the present invention, the first elongate member 80 can define an upper end 81 and a lower end 84. The lower end 84 of the first elongate member 80 can be coupled with the first actuating handle 70, and the upper end 81 of the first elongate member 80 can be coupled to the first hub 30. The first elongate member 80 can be made of a variety of materials, such as metal, plastic, and can be elastic or inelastic. However, in a preferred embodiment, the first elongate member 80 can be fabricated from a substantially rigid material such that a position of the first hub 30 can be fixed relative to a position of the first actuating handle 70.

Referring still to FIG. 1, the umbrella 10 can further include a canopy support frame 14 that can be configured to include a first hub 30, a second hub 32, and an intermediate hub 34. Additionally, the canopy support frame 14 can include a first plurality of ribs 40 that can each define a first end 42 and a second end 44. According to an implementation of the present invention, the first ends 42 of the first plurality of ribs 40 can be coupled with the first hub 30 such that the second ends 44 are disposed away from the first hub 30. Furthermore, the canopy support frame 14 can further include a second plurality of ribs 50. Each of the second plurality of ribs can define a first end 52 and a second end 54. In this regard, it is contemplated that the first ends 52 of the second plurality of ribs 50 can be coupled to the second hub 32. Additionally, the second ends 52 of the second plurality of ribs can each be coupled to a respective rib of the first plurality of ribs 40 such that the first plurality of ribs 40 can be operatively coupled to the second plurality of ribs 50 in forming the canopy support frame 14, according to an implementation of the present invention.

Figure 2:
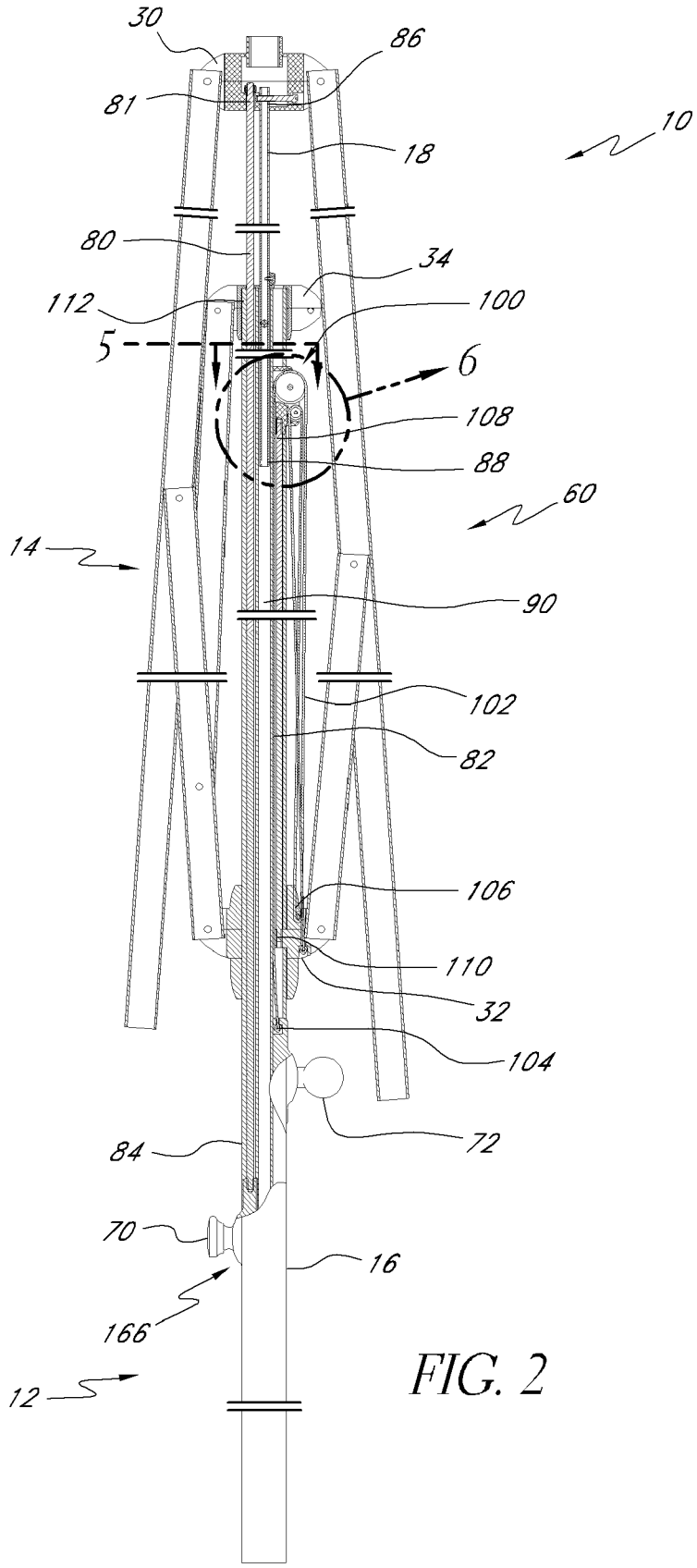
FIG. 2 is a plan view of an umbrella according to the invention, partly cut away and showing the umbrella in a closed position
Figure 3:
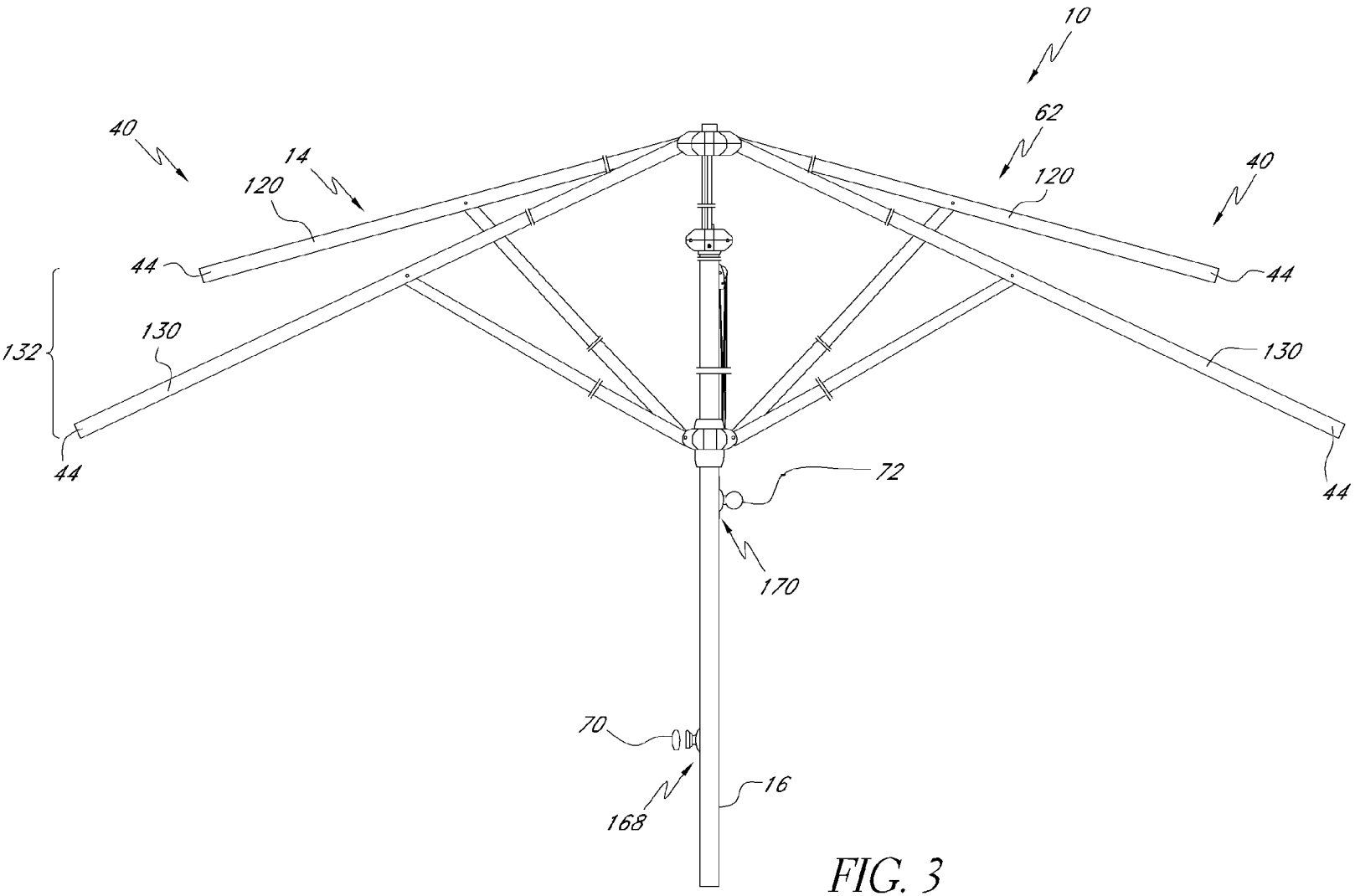
FIG. 3 is plan view of an umbrella according to the invention, showing the umbrella in a first open position.

In accordance with an aspect of the present invention, the canopy support frame 14 of the umbrella 10 can be moved from a closed position 60 (shown in FIG. 2) to an open position 62 (shown in FIGS. 1 and 3). In some implementations, the canopy support frame 14 can be operative to move to an extended position 64 (shown in FIG. 4). Additionally, as shown in hidden lines in FIG. 1, the canopy support frame 14 can be used to support a canopy 66, which can be coupled to the canopy support frame 14 in such a manner as to ensure that the canopy 66 can be manipulated in shape in response to the movement of the canopy support frame 14. In this regard, the canopy 66 can comprise one or more individual canopy portions that collectively form the canopy 66. It is contemplated that the canopy 66 can therefore have a variety of possible configurations, shapes, and other features that may be beneficial in using the umbrella 10. Such modifications are contemplated as being within the scope of embodiments of the present invention.

Referring still to FIG. 1, the umbrella 10 can comprise at least a first actuating handle 70 that is operative to manipulate the configuration of the canopy support frame 14. According to an implementation, movement of the first actuating handle 70 can produce a corresponding movement of the canopy support frame 14 from the closed position 60 to the open position 62. For example, the first actuating handle 70 can be vertically translated along the lower pole 16 in order to effectuate movement of the canopy support frame 14 from the closed position 60 to the open position 62. In this regard, according to an embodiment of the present invention, it is contemplated that the first actuating handle 70 can be at least partially disposed within the first elongate channel 20 of the lower pole 16 in order to facilitate translatable vertical movement of the first actuating handle 70 along the lower pole 16. The lower or main pole 16 extends downwardly into a base (not shown).

According to another aspect of the present invention, the umbrella 10 can further comprise a second actuating handle 72. As illustrated in FIG. 1, the second actuating handle 72 can be separate from the first actuating handle 70. For example, the first actuating handle 70 can be disposed opposite the second actuating handle 72. In an implementation of the present invention, movement of the second actuating handle 72 can produce a corresponding movement of the canopy support frame 14 from the open position 62, shown in FIGS. 1 and 3, to the extended position 64, shown in FIG. 4.

Similar to the first actuating handle 70, although the movement of the second actuating handle 72 can be any one of a variety of movements, it is contemplated that the second actuating handle 72 can be configured to be vertically translatable in order to effectuate the corresponding movement of the canopy support frame 14 from the open position 62 to the extended position 64. In particular, the lower pole 16 can further include a second elongate channel 74.

Similar to the first elongate channel 20, the second elongate channel 74 can be separate from the lower pole 16. In an implementation of the present invention, the second elongate channel 74 can be at least partially recessed in the outer surface 22 of the lower pole 16. Therefore, in accordance with an aspect of the present invention, the second actuating handle 72 can be sized and configured to be at least partially disposed within the second elongate channel 74 in order to facilitate translatable movement of the second actuating handle 72 along the lower pole 16.

Referring now to FIG. 2, the umbrella 10 is shown in the closed position 60. Further, FIG. 2 provides a partial cross-sectional view along an axis of the support pole assembly 12. As shown therein, the umbrella 10 can further include a first elongate member 80. The first elongate member 80 can be disposed in parallel relation relative to the support pole assembly 12. However, the first elongate member 80 can preferably be at least partially disposed within the first elongate channel 20.

According to an implementation of the present invention, the first elongate member 80 can define an upper end 82 and a lower end 84. The lower end 84 of the first elongate member 80 can be coupled with the first actuating handle 70, and the upper end 82 of the first elongate member 80 can be coupled to the first hub 30. The first elongate member 80 can be made of a variety of materials, such as metal, plastic, and can be elastic or inelastic. However, in a preferred embodiment, the first elongate member 80 can be fabricated from a substantially rigid material such that a position of the first hub 30 can be fixed relative to a position of the first actuating handle 70.

Therefore, as illustrated in FIG. 2, and as further described below with reference to FIG. 5, the first elongate member 80 can preferably be a compression member such as a cylindrical or other shaped rod that provides a coupling between the first hub 30 and the first actuating handle 70 in order to ensure that the distance between the first hub 30 and the first actuating handle 70 is relatively constant. In this regard, vertical displacement of the first actuating handle 70 can therefore result in a corresponding vertical displacement of the first hub 30. As described further below, upon translating the first actuating handle 70 downwardly along the lower pole 16, the first hub 30 can likewise be translated downwardly, and due to the configuration of the canopy support frame 14, the canopy support frame can be moved from the closed position 60 to the open position 62.

According to another aspect of the present invention, the upper pole 18 of the support pole assembly 12 can be configured to provide stability to the first hub 30 and to ensure that the first hub 30 translates axially relative to the support pole assembly 12. As illustrated in FIG. 2, the upper pole 18 can define an upper end 86 and a lower end 88. The upper end 86 can be coupled to the first hub 30 and the lower end 88 can be slidable within a central passage 90 of the lower pole 16. In this regard, the upper pole 18 is preferably sized and configured to ensure that the lower end 88 is maintained within the central passage 90 of the lower pole 16 during all translational movement of the first hub 30.

According to yet another aspect of the present invention, the umbrella 10 can further comprise a pulley assembly 100. The pulley assembly 100 can be used to operatively interconnect the second actuating handle 72 with the second hub 32 in order to facilitate movement of the canopy support frame 14 from the open position 62 to the extended position 64. As shown in FIG. 2, the second actuating handle 72 can be interconnected to the second hub 32 via a tension member 102. The tension member 102 can define a first end 104 that can be coupled to the second actuating handle 72, and a second end 106 that can be coupled to the second hub 32. According to an implementation of the present invention, the tension member 102 can be a wire or other flexible cord and can extend upwardly from the second actuating handle 72 to engage the pulley assembly 100 and then descend downwardly toward the second hub 32. A more detailed description of an exemplary configuration and operation of the pulley assembly 100 and the tension member 102 are provided below.

Referring still to FIG. 2, the umbrella 10 can further comprise a second elongate member 82. The second elongate member 82 can define an upper end 108 and a lower end 110. As mentioned above with respect to the first elongate member 80, the second elongate member 82 can also be fabricated from a similar variety of materials. Preferably, the second elongate member 82 is fabricated from a material. Thus, as shown in FIG. 2, the second elongate member 82 can be utilized to ensure that an axial position of the pulley assembly 100 is in fixed relation relative to at least a portion of the second hub 32.

In this regard, the lower end 110 of the second elongate member 82 can be coupled to at least a portion of the second hub 32 and the upper end 108 of the second elongate member 82 can be coupled to the pulley assembly 100. As described in greater detail below, such an embodiment of the present invention can be beneficially used with a "split" or "nested" second hub 32, which will be described further below. Nevertheless, it is contemplated that other embodiments of the present invention can be fabricated without the use of the second elongate member 82. Further, in such alternative embodiments, the pulley assembly 100 can be fixed relative to the lower pole 16 in order to ensure that the second hub 32 can be moved in response to the movement of the second actuating handle 72.

As illustrated in FIG. 2, it is contemplated that at least one of the first hub 30, the second hub 32, and the intermediate hub 34 can be sized and configured to be vertically translatable relative to the support pole assembly 12. For example, as mentioned above, the first hub 30 can be vertically translatable relative to the lower pole 16 of the support pole assembly 12, with the upper pole 18 tending to ensure that the first hub 30 can be stabilized and axially translated with respect to the lower pole 16. In addition, it is contemplated that at least a portion of the second hub 32 can be vertically translatable along the lower pole 16. As will be described in greater detail below, various embodiments of the present invention can incorporate different configurations of the second hub 32 which can provide varying degrees of relative movement of portions of the second hub 32.

According to a preferred embodiment, the intermediate hub 34 can be positioned in a fixed relationship relative to the lower pole 16. For example, the intermediate hub 34 can be coupled to a top end 112 of the lower pole 16. Nevertheless, it is contemplated that other configurations of the umbrella 10 can provide that the intermediate hub 34 be vertically translatable with respect to the lower pole 16. Exemplary operation of the first hub 30, the second hub 32, and the intermediate hub 34 are described in greater detail below.

Referring now to the front plan view of FIG. 3, the umbrella 10 is shown in the open position 62. The view of the umbrella in FIG. 3 provides only a partial illustration of the canopy support frame 14. In accordance with an aspect of the present invention, the canopy support frame 14 can be configured such that the first and second pluralities of ribs 40, 50 can combine to form a non-uniform configuration.

In this regard, as shown in FIG. 3, the canopy support frame 14 can be configured to include at least one up member 120 and at least one down member 130. Each of the up and down members 120, 130 can be individually comprised of at least one of the first plurality of ribs 40 and at least one of the second plurality of ribs 50. In one implementation, the canopy support frame 14 can include two up members 120 (both shown in FIG. 3) and six down members 130 (wherein only two are visible in FIG. 3). As shown in FIG. 3, in the open position 62, the second ends 44 of each of the up members 120 can be positioned at a same or greater height or elevation than the second ends 44 of the down members 130.

According to an aspect of the present invention, movement of the first actuating handle 70 can cause the canopy support frame to move from the closed position 60 to the open position 62 illustrated in FIG. 3. For example, upon being raised to the open position 62, the second ends 44 of the first plurality of ribs 40 can be raised to a first elevation 132. The term "first elevation 132" can refer broadly to the general positioning of the second ends 44 of the canopy support frame 14 when the canopy support frame 14 is in the open position 62.

With regard to the first elevation 132, where the canopy support frame 14 is configured in a uniform fashion, each of the second ends 44 of the first plurality of ribs 40 can be raised to substantially the same elevation or height. However, in another embodiment, which has been described above, the canopy support frame 14 can be configured in a non-uniform fashion, wherein the second ends 44 of the respective ones of the up members 120 and the down members 130 can be positioned at different heights. In this regard, although the second ends 44 of the up members 120 and the down members 130 may be positioned at different heights when the canopy support frame 14 is in the open position 62, each of these second ends 44 can be considered to be at the first elevation 132. Additional description and comparison will be provided below with regard to the extended position 64 of the canopy support frame 14.

Figure 4:
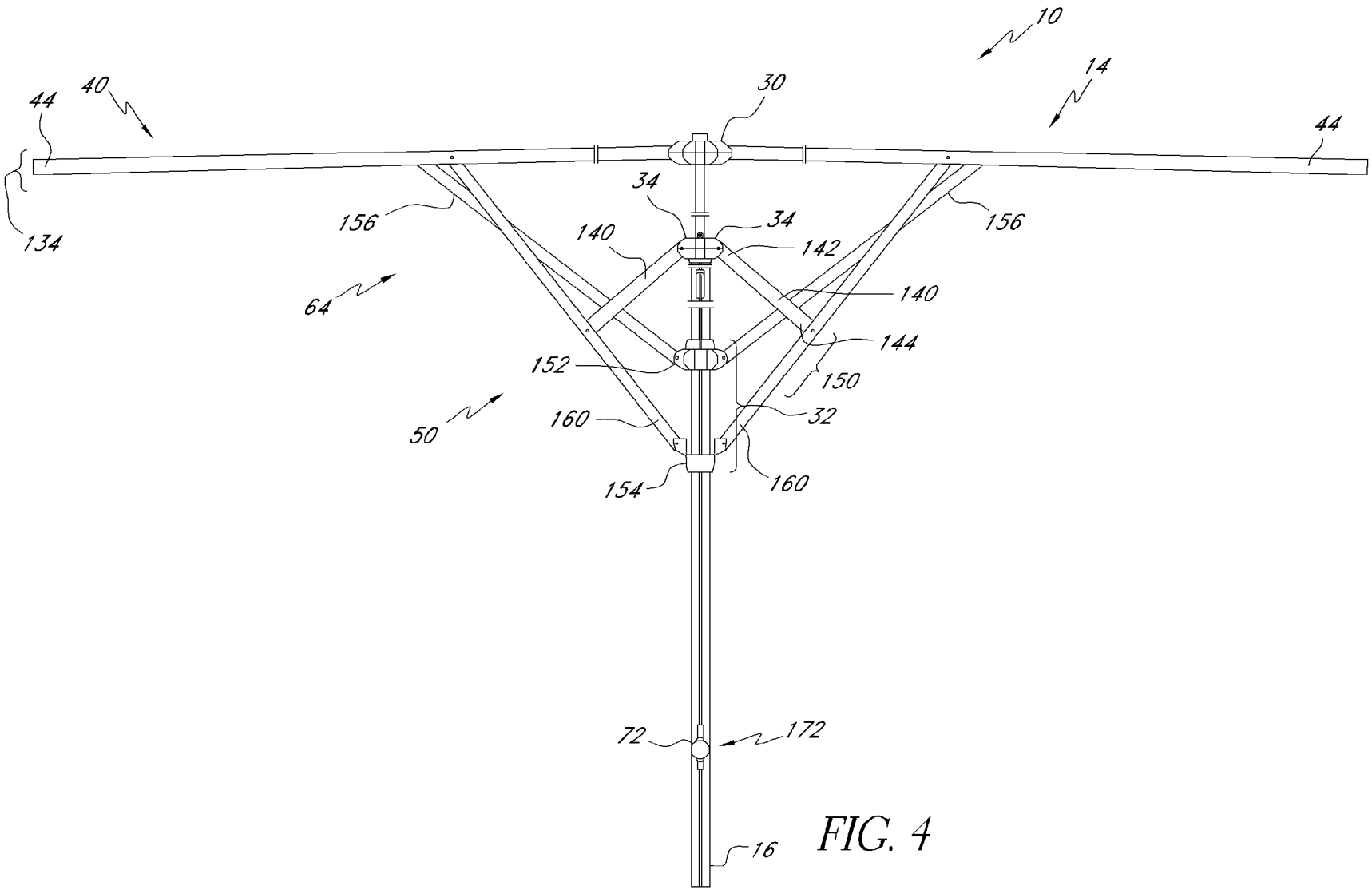
FIG. 4 is a plan view of an umbrella according to the invention, showing the umbrella in a second open position.

With reference now to the side plan view of FIG. 4, the umbrella 10 is illustrated as being in the extended position 64. As shown therein, each of the second ends 44 of the first plurality of ribs 40 can be positioned at a second elevation 134. The term "second elevation 134" can refer broadly to the general positioning of the second ends 44 of the canopy support frame 14 when the canopy support frame 14 is in the extended position 64. According to one implementation of the present invention, the second ends 44 of the first plurality of ribs 40 can be positioned at approximately the same height when in the extended position 64. Further, the first plurality of ribs 40 can collectively define a common plane when in the extended position 64.

Similar to the first elevation 132, the second elevation 134 is not limited to a configuration wherein each of the second ends 44 are at exactly the same height. However, when in the extended position 64, each of the second ends 44 can preferably be at approximately the same height at the second elevation 134. Nevertheless, other configurations are contemplated, wherein the second ends of the first plurality of ribs 40 can be positioned at substantially different heights when positioned at the second elevation 134. Such a concept is similar to that discussed above with respect to the first elevation 132.

According to an aspect of the present invention, it is contemplated that the second elevation 134 can be generally higher than the first elevation 132. Thus, when the canopy support frame 14 moves from the open position 62 to the extended position 64, at least one of the second ends 44 of the canopy support frame 14 should be raised from the first elevation 132 to the second elevation 134. Preferably, each of the second ends 44 can be moved from the first elevation 132 upwardly to the second elevation 134 when the canopy support frame 14 moves from the open position 62 to the extended position 64.

Referring still to FIG. 4, it is contemplated that the canopy support frame 14 can further comprise at least one support strut 140. The support strut can define a first end 142 and a second end 144. The first end 142 of the support strut 140 can be coupled to the intermediate hub 34, as illustrated in FIG. 4. The second end 144 of the support strut 140 can be coupled to one of the second plurality of ribs 50. FIG. 4 is an exemplary illustration wherein two support struts 140 can operatively interconnect two of the second plurality of ribs 50 with the intermediate hub 34.

Additional configurations can be provided, wherein more than two support struts 140, such as four or six, can be used in the canopy support frame 14. Thus, more than two of the second plurality of ribs 50 can be interconnected to the intermediate hub 34. In this regard, the combination of one of the second plurality of ribs 50 with one of the support struts 140 can be collectively referred to as a strut pair 150.

As illustrated in FIG. 4, it is contemplated that the second hub 32 can comprise at least a first hub component or runner 152 and a second hub component or runner 154, in what was previously referred to as a "split" or "nested" second hub 32. According to an implementation of the present invention, the first and second runners 152, 154 can each be coupled to at least one of the second plurality of ribs 50 at the first ends 54 thereof. As mentioned above, although it is contemplated that the second plurality of ribs 50 can be coupled to a common second hub 32, the first and second runners 152, 154 can be provided such that selected ones 156 of the second plurality of ribs 50 are coupled to the first runner 152 and remaining ones 160 of the second plurality of ribs 50 are coupled to the second runner 154. The selected ones 156 can be those of the second plurality of ribs 50 that are not coupled to the second runner 154, and are shown in hidden lines in FIG. 4.

In FIG. 4, an embodiment is illustrated wherein two remaining ones 160 of the second plurality of ribs 50 are coupled to the second hub component or runner 154. As illustrated in FIG. 4, the two remaining ones 160 can each respectively be part of the illustrated strut pairs 150 coupled to the second runner 154, the intermediate hub 34, and a respective one of the first plurality of ribs 40. Such a configuration can be repeated for additional strut pairs 150. Thus, as shown in FIG. 4, at least two strut pairs can be operatively connected in such a manner.

FIG. 4 also illustrates that the first hub component or runner 152 can be coupled to the remaining ones 160 of the second plurality of ribs 50. With reference to FIG. 4 and to FIG. 3, it is contemplated that the selected ones 160 of the second plurality of ribs 50 can be respectively coupled to the up members 120 and the down members 130. Various other configurations can be implemented utilizing the teachings herein.

With reference now to FIGS. 2 and 3, it is contemplated that the first actuating handle 70 can be moved from a first position 166 to a second position 168 in order to move the canopy support frame from the closed position 60 to the open position 62. Referring now to FIGS. 3 and 4, it is contemplated that the second actuating handle 72 can be moved from a first position 170 to a second position 172 in order to move the canopy support frame 14 from the open position 62 to the extended position 64, respectively. In this regard, it is contemplated that the first positions 166, 170 of the respective ones of the first and second actuating handles 70, 72 can be higher than the second positions 168, 172, respectively. Thus, the first and second actuating handles 70, 72 can be vertically translatable along the lower pole 16 and can be at least partially disposed within the respective ones of the first and second elongate channels 20, 74, according to an implementation of the present invention.

Figure 5:
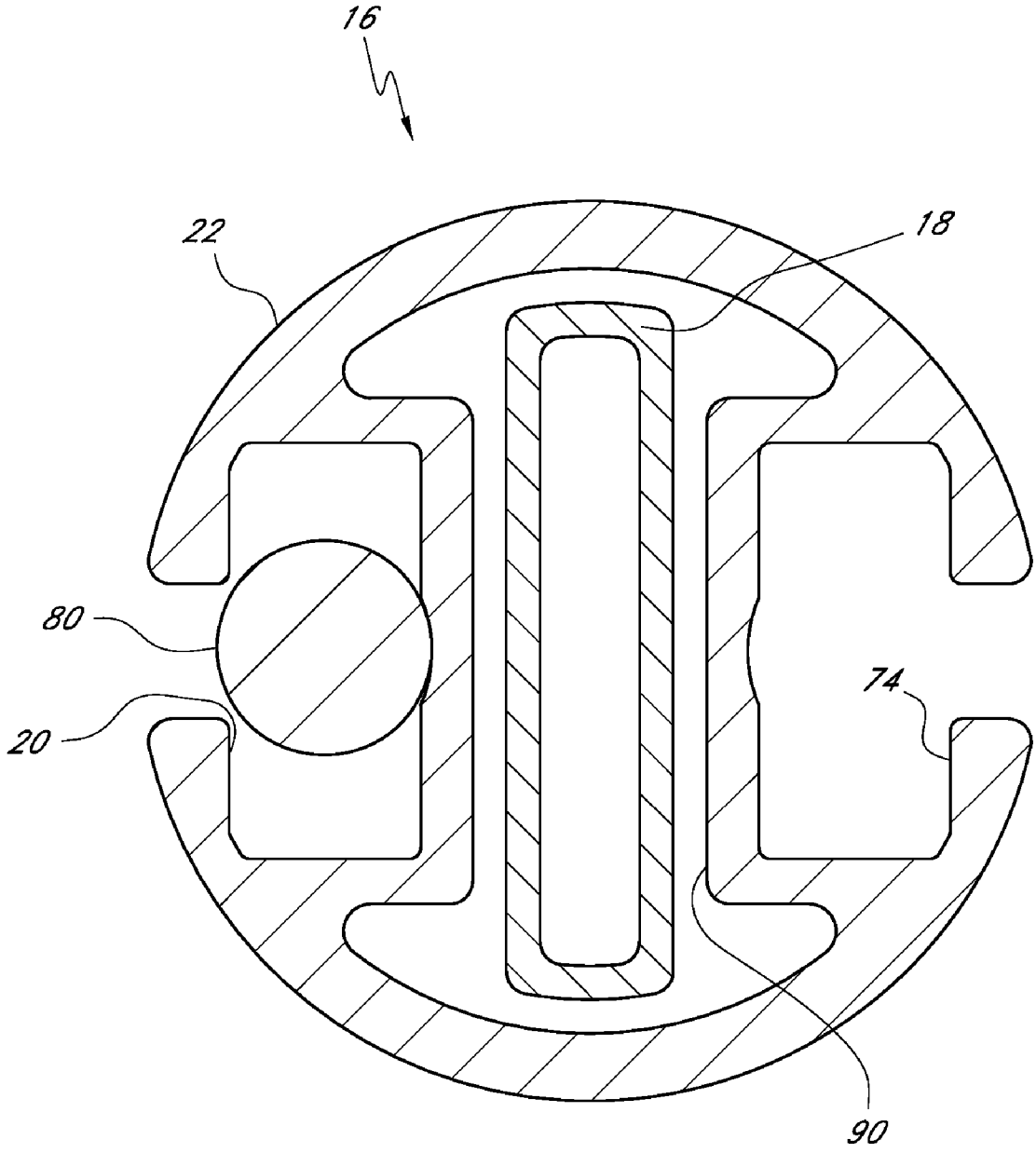
FIG. 5 is a cross-sectional view of the umbrella shown in FIG. 2, taken along the lines 5-5.

Referring now to FIG. 5, an exemplary cross-section of the lower pole 16, as called out in FIG. 2, is illustrated. As mentioned previously, the lower pole 16 can define a substantially circular cross-sectional periphery. Further, the first and second elongate channels 20, 74, can be at least partially recessed in the outer surface 22 of the lower pole 16. The first and second elongate channels 20, 74 can define substantially rectangular cross-sections that can be sized and configured to retain at least a portion of the respective ones of the first and second actuating handles 70, 72 therewithin while permitting the first and second actuating handles 70, 72 to be translatable therewithin.

The position of the cross-section illustrated in FIG. 5, as called out in FIG. 2, is adjacent the top end 112 of the lower pole 16. Therefore, the cross-sectional illustration of FIG. 5 further illustrates a cross-section of the first elongate member 80, which can be sized and configured to be translatable within the first elongate channel 20. Further, FIG. 5 also illustrates a cross-section of the upper pole 18 that can be disposed within the central passage 90 of the lower pole 16. As shown, the upper pole 18 can have a substantially rectangular cross-section. Nevertheless, the configurations and sizes of the elements shown in the embodiment of FIG. 5 can be variously modified and can further include additional features that compliment and/or facilitate the implementation of such an embodiment of the present invention.

Figure 6:
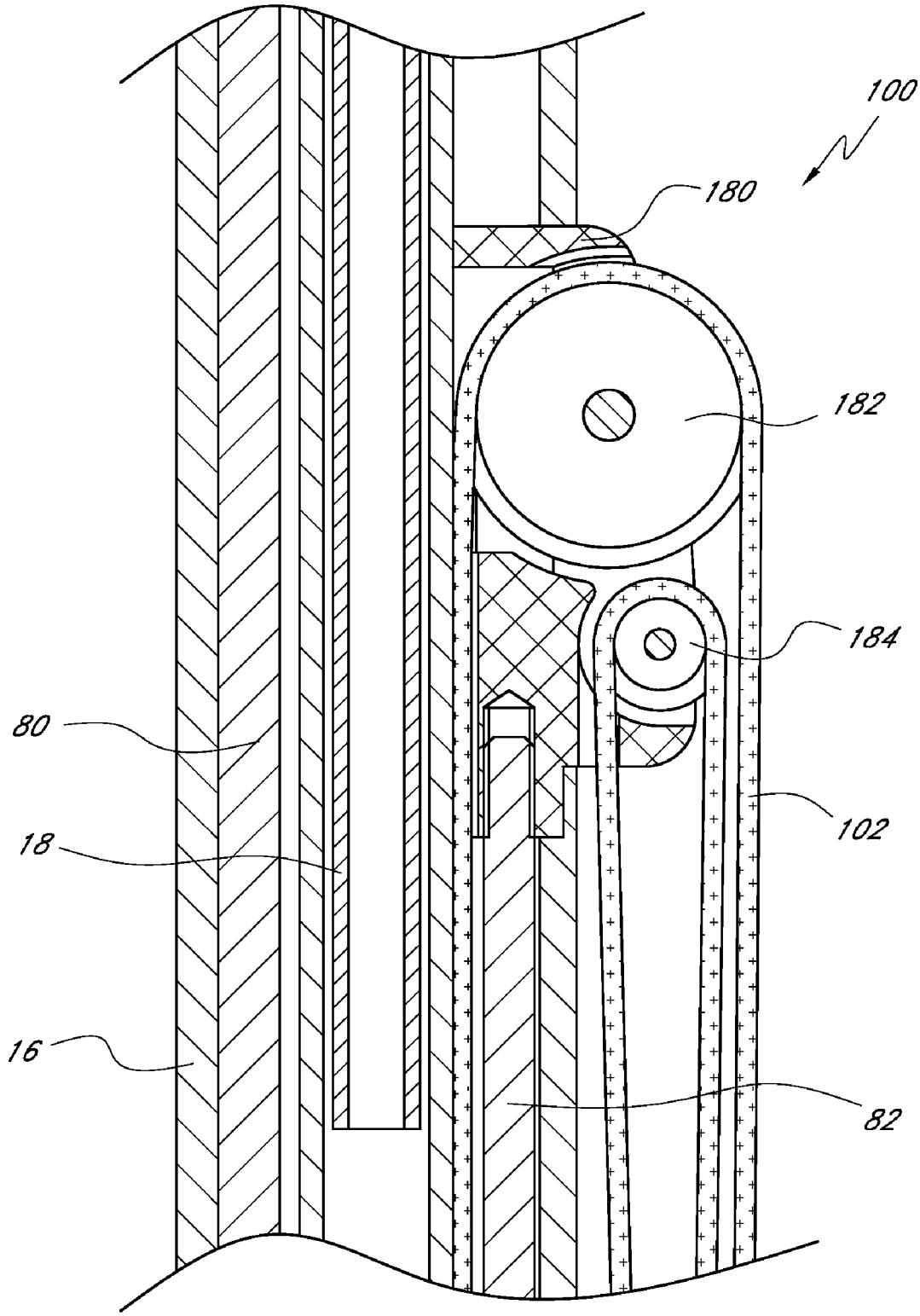
FIG. 6 is a cross-sectional view of the umbrella shown in FIG. 2, partly broken away.

Referring now to FIG. 6, a cross-section of the umbrella 10, as called out in FIG. 2, is provided. FIG. 6 illustrates an exemplary configuration of the pulley assembly 100. As shown, the pulley assembly 100 can include a pulley block 180 and at least a first roller 182. In the embodiment illustrated in FIG. 6, the pulley assembly 100 can further include a second roller 184. The first and second rollers 182, 184 can be rotatably coupled to the pulley block 180. Further, the pulley block 180 can be sized and configured such that the tension member 102 can be introduced therethrough and disposed onto the first and second rollers 182, 184.

As shown in FIGS. 2 and 6, in an exemplary embodiment, the first end 104 of the tension member 102 can be coupled to the second actuating handle 72. The tension member 102 can then extend upwardly from the second actuating handle 72 toward the pulley assembly 100. As shown in FIG. 6, the tension member 102 can then engage the first roller 182 and extend downwardly toward the second hub 32. The tension member 102 can then engage a third roller (not shown) that is rotatably coupled to the second hub 32 (such as on the first runner 152) and then extend upwardly again toward the pulley assembly 100. Finally, the tension member can then engage the second roller 184 and extend downwardly toward the second hub 32, where the second end 106 of the tension member 102 can be coupled. Thus, in such a configuration, with the pulley assembly 100 being fixed relative to the second runner 154 of the second hub 32, the first runner 152 can be vertically translated along the lower pole 16 upon vertical translation of the second actuating handle 72.

According to another aspect of the present invention, the pulley assembly 100 can be sized and configured to be vertically translatable along the lower pole 16. In this regard, it is contemplated that the second elongate channel 74, or another channel similarly disposed, can be disposed along the lower pole 16 at least intermediate the second hub 32 and the intermediate hub 34, such that the pulley assembly 100 can be vertically translatable along the channel. In such a configuration, as described below, the second runner 154 and the pulley assembly 100 can both move along the lower pole 16 in response to the movement of the first actuating handle 70. In some embodiments, the second runner 154 and the pulley assembly 100 can move together along the lower pole 16. For example, the space between the second runner 154 and pulley assembly 100 can remain constant as the translation occurs. FIG. 6 illustrates an exemplary spacing and configuration of the first elongate member 80, the upper pole 18, and the second elongate member 82.

Figure 7:
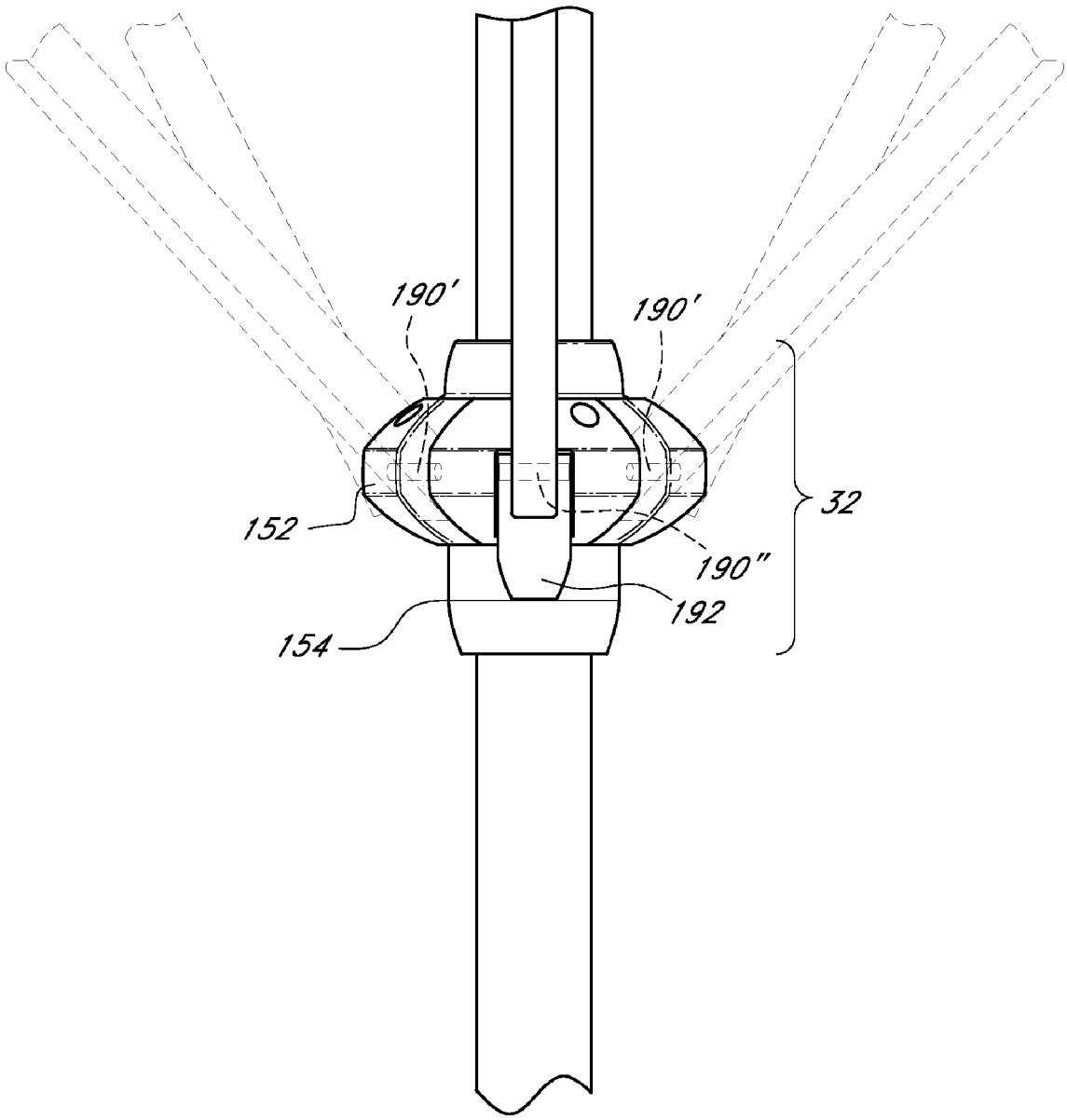
FIG. 7 is a plan view of the umbrella shown in FIG. 1, showing detail around the lower hub thereof.

Referring now to FIG. 7, it is contemplated that the second hub 32 can be configured such that the first and second runners 152, 154 can be nested. As shown in FIG. 7, a plurality of coupling pins can be used to couple the second plurality of ribs 50 to the second hub 32. Preferably, when in a nested position, the coupling pins 190' of the first runner 152 can be disposed at substantially the same height as the coupling pins 190" of the second runner 154. In this regard, as shown in FIG. 7, the second runner 154 can be configured to include a pair of opposing shoulders 192 whereat the respective ones of the second plurality of ribs 50 can be coupled to the second runner 154. The shoulders 192 preferably can be sized and configured with the coupling pins 190" disposed therein being at substantially the same height as the coupling pins 190' of the first runner 152 when the second hub 32 is in the nested position. The first and second runners 152, 154 can be variously configured and modified utilizing the teachings herein.

Figure 5A:
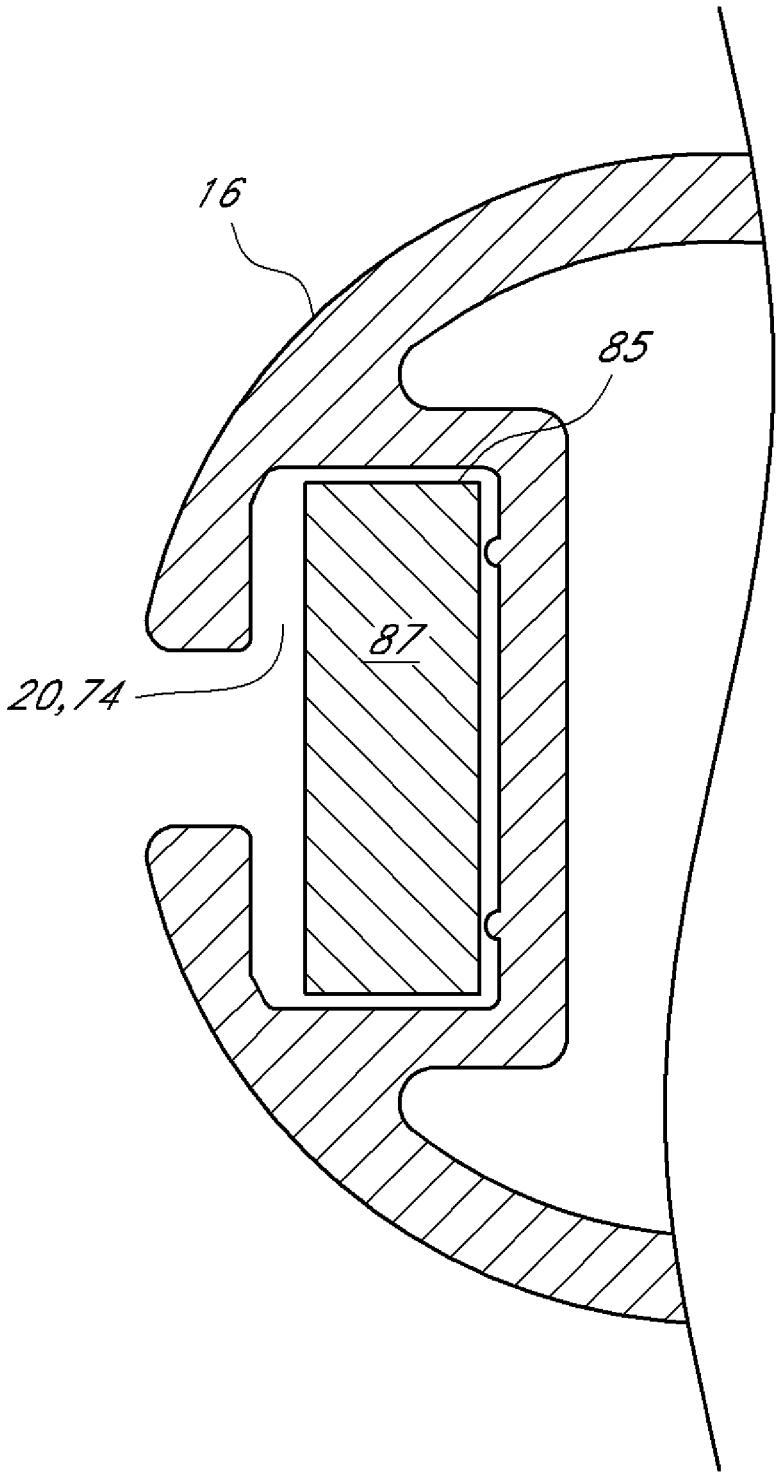
FIG. 5A is a partial cross-sectional view of one embodiment of the umbrella shown in FIG. 2, taken at first actuating handle 70 or second actuating handle 72.

As shown in FIG. 5A, and in accordance with yet another aspect of the present invention, it is contemplated that the first and second actuating handles 70, 72 can further define an engagement surface 85 and include a tightening element 87 that allows the engagement surfaces 85 of the first and second actuating handles 70, 72 to frictionally engage the lower pole 16. For example, the tightening element 87 can be a clamp or screw that allows the first and second actuating handles 70, 72 to clamp onto the outer surface 22 of the lower pole 16, such as onto a ridge formed by the first and second elongate channels 20, 74.

Additionally, the tightening element 87 can cause the first and second actuating handles 70, 72 to expand within the first and second elongate channels 20, 74 to thereby frictionally engage the lower pole 16. Thus, the first and second actuating handles 70, 72 can be positioned in a fixed position relative to the lower pole 16. Using this feature, once the umbrella 10 has moved to the open position 62 and the extended position 64, the frictional engagement of the first and second actuating handles 70, 72 can maintained the position of the first and second actuating handles 70, 72 at the respective second positions 168, 172.

As discussed above with respect to FIGS. 4 and 7, the second hub 32 can comprise at least the first hub component or runner 152 and the second hub component or runner 154. As such, the second hub 32 can be referred to as a "split", "nested" or "embedded" hub. As shown in a bottom perspective view of FIG. 8, the second hub 32 is "split" in that it comprises more than one component, and is "nested" in that at least a portion of the second runner 154 can be fitted to within a cavity or recess of the first runner 152. Alternatively, the second hub 32 can be configured such that the first runner 152 fits to within a recess of second runner 154. Further, the first and second runners 152, 154 can each include cavities or recesses into which certain portions of the other respective runners 152, 154 can be received.

This type of fitting between the first and second hub components or runners 152, 154 can have several aesthetic and mechanical advantages. For example, not only will the first and second runners 152, 154 create a streamlined and integrated appearance, but the integrated fit of some embodiments can tend to create greater structural rigidity of the umbrella rib structure.

Figure 8:
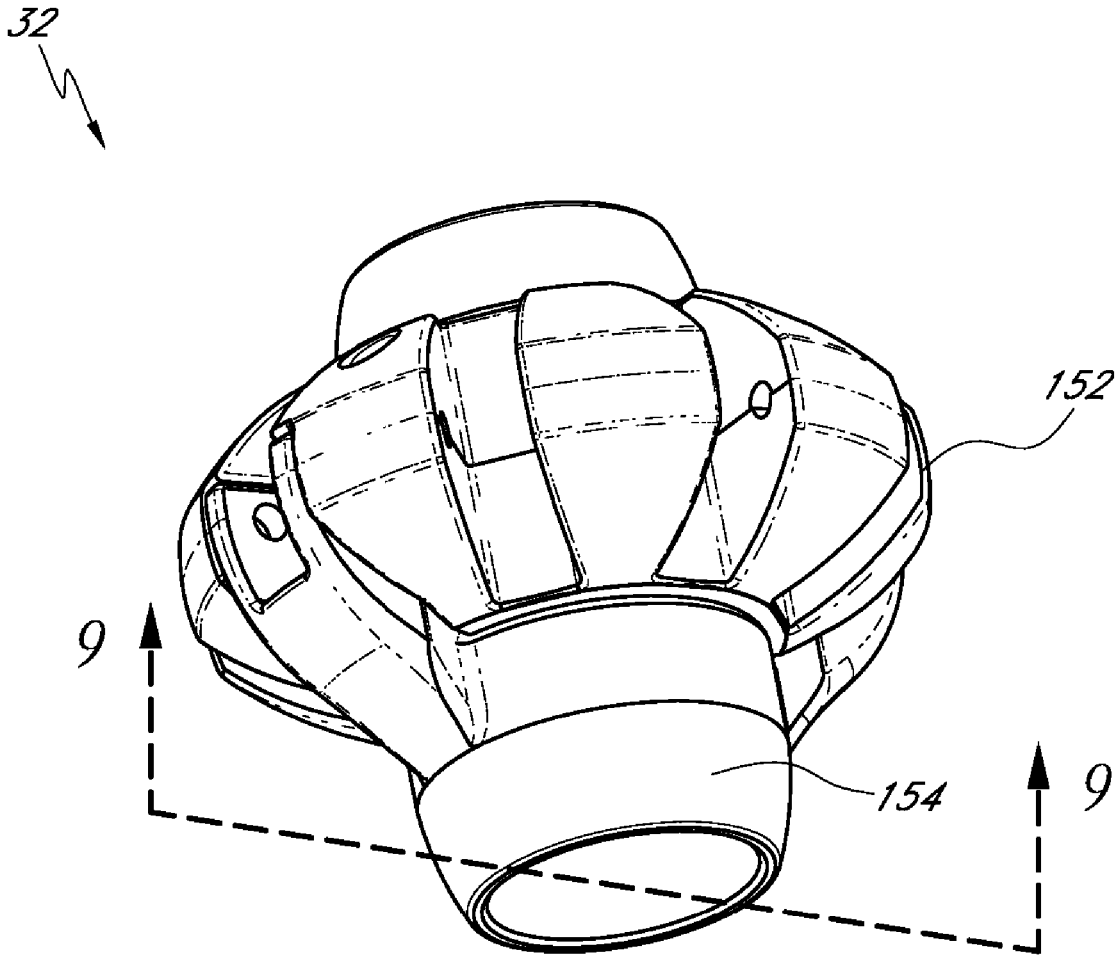
FIG. 8 is a bottom perspective view of a second hub illustrating a nested arrangement of first and second runners of the hub, in accordance with an embodiment.
Figure 9:
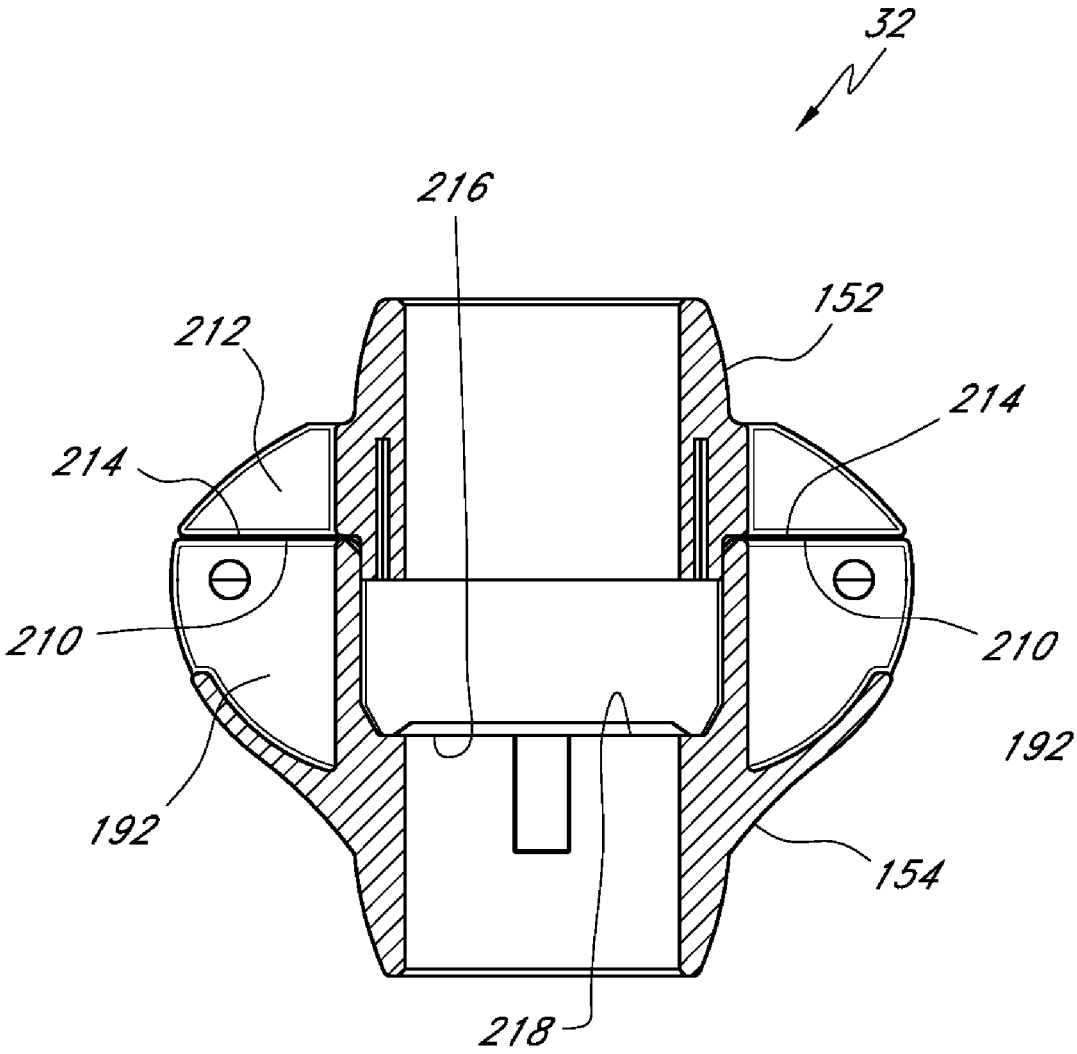
FIG. 9 is a side cross-sectional view of the hub shown in FIG. 8.

Referring now to FIG. 9, a side cross-sectional view of the second hub 32 of FIG. 8 is shown. As illustrated therein, the second runner 154 can include a pair of opposing shoulders 192, which can be diametrically opposed on the second runner 154. The opposing shoulders 192 can be received to within a nesting cavity 210 of the first runner 152. Accordingly, the first runner 152 can include a corresponding number of nesting cavities 210 such as required by the configuration of the second runner 154. The nesting cavities 210 and the opposing shoulders 192 can be configured to provide a very close fit when the second runner 154 is nested with the first runner 152.

Although sides of the nesting cavity 210 and opposing shoulders 192 are illustrated in the embodiment of FIG. 9 as being straight, it is contemplated that other interlocking features can be present in the configurations of the nesting cavity 210 and the shoulders 192. Further, as shown in FIG. 9, the first runner 152 can include opposing abutments 212 that can be configured to abut top surfaces 214 of the opposing shoulders 192. In some embodiments, the top surfaces 214 of the opposing shoulders 192 can be configured to include features that mate with corresponding features of the opposing abutments 212. Other various modifications can be implemented in order to facilitate interconnection and stability of the second hub 32.

In accordance with some embodiments, the second hub component or runner 154 and the first hub component or runner 152 can include corresponding surfaces that mate in order to facilitate nesting of the first and second runners 152, 154 with each other. These structures can maintain a generally fixed orientation of the second runner 154 with respect to the first runner 152 when in the nested position. For example, as discussed above, the top surface 214 of the second runner 154 can mate with the opposing abutment 212 when the opposing shoulders 192 are received to within the nesting cavities 210.

In other embodiments, the nesting cavities 210 can be configured with a depth corresponding to a height of the opposing shoulders 192. Accordingly, the top surface 214 can mate with the abutment 212 and a lower surface 216 of the first runner 152 can abut an upper surface 218 of the second runner 154 when the first and second runners 152, 154 are in the nested position.

In such embodiments, the first and second runners 152, 154 can be configured to allow vertical forces to be evenly distributed intermediate the first and second runners 152, 154. As such, some embodiments can therefore provide that when the second runner 154 is in a fixed position along the pole of the umbrella, the weight or downward force exerted by the first runner 152 can be evenly born along the upper surface 218 and the top surface 214 of the second runner 154 rather than creating point loads at discrete locations on the second runner 154. Failure and warpage of the components of the umbrella can thereby be mitigated and/or prevented.

Figure 10A:
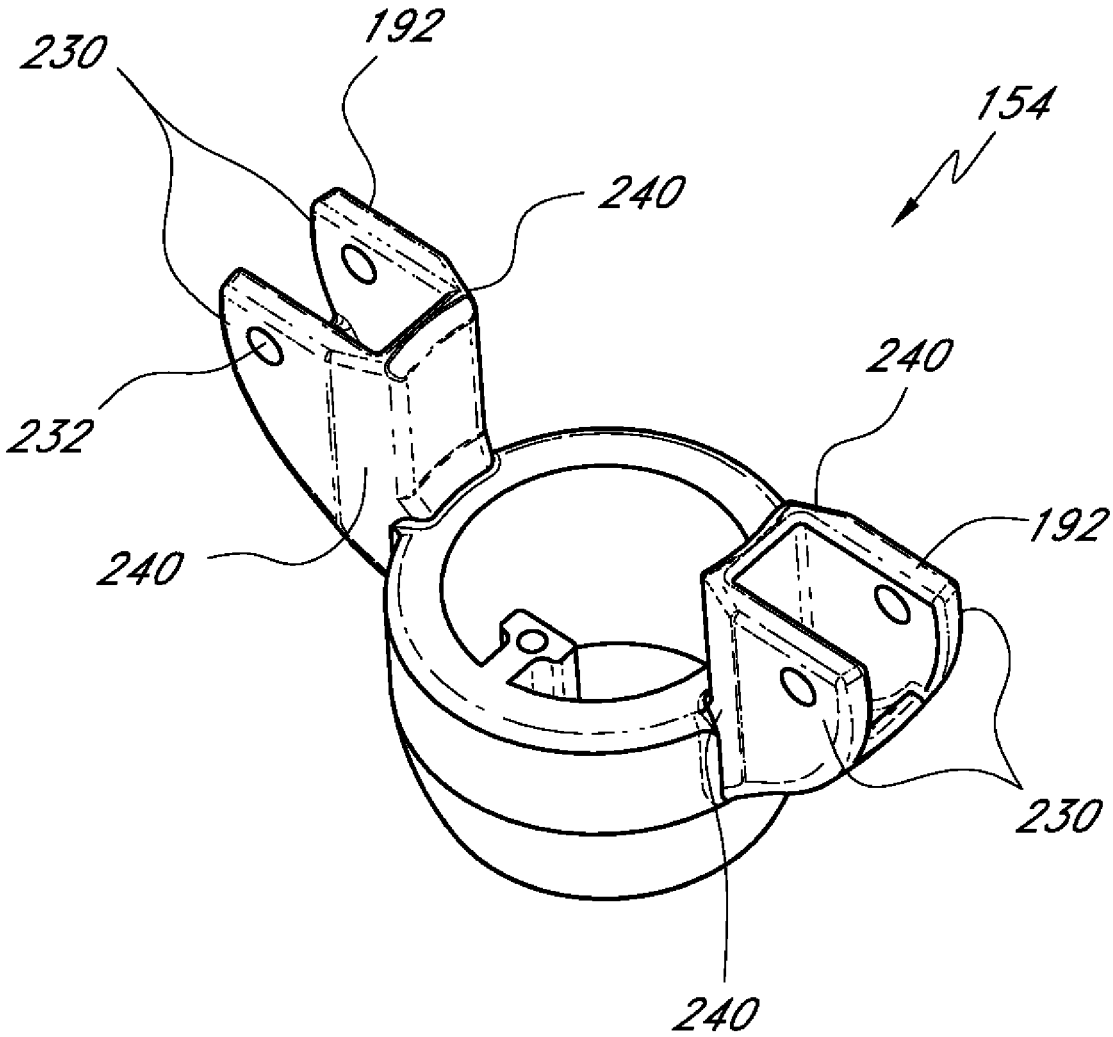
FIG. 10A is a top perspective view of the second runner of the hub shown in FIG. 8.
Figure 10B:
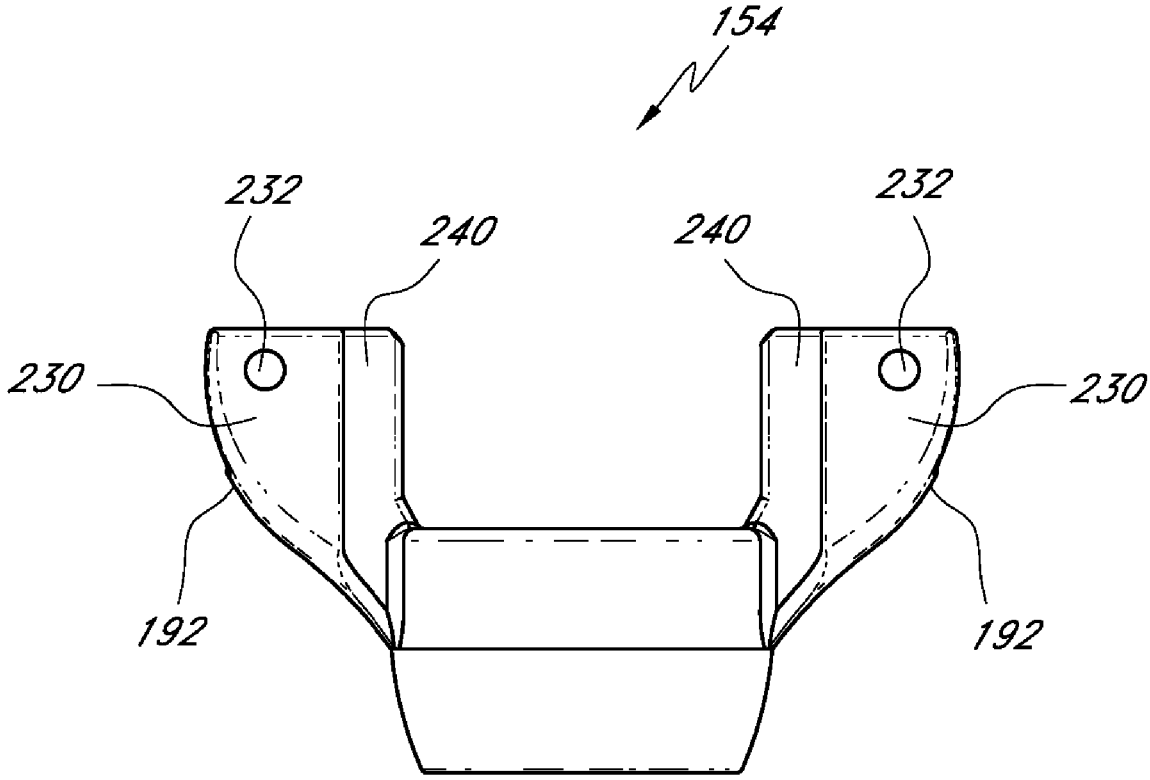
FIG. 10B is a side view of the second runner shown in FIG. 10A.
Figure 10C:
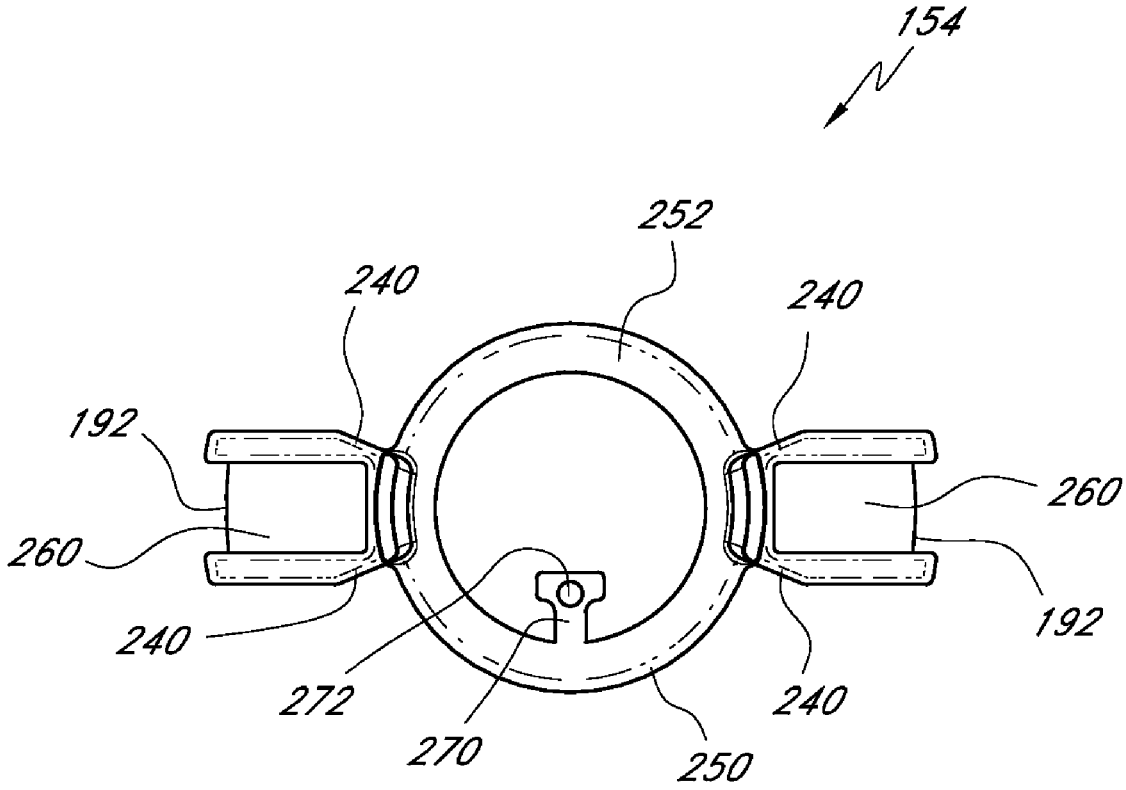
FIG. 10C is a top view of the second runner shown in FIG. 10A.

FIGS. 10A-C illustrate an exemplary embodiment of the second runner 154. As shown in the perspective view of FIG. 10A, the opposing shoulders 192 can be configured to include a pair of vertical side walls 230. Each of the opposing side walls can include an aperture 232 configured to receive a pin in order to interconnect an umbrella rib with one of the opposing shoulders 192. Although the embodiment illustrated in FIGS. 10A-B shows the apertures 232 disposed along an upper area of the opposing side walls 230, the apertures 232 can be disposed at any appropriate location based on the configuration of the opposing shoulders 192.

In some embodiments, the opposing shoulders can also include tapered sections 240. As discussed above, the tapered sections can represent a feature of the opposing shoulders 192 that can assist in maintaining a generally fixed orientation of the second runner 154 relative to the first runner 152 when in the nested position. The tapered sections 240, as noted further below, can mate with a corresponding structure of the first runner 152. As shown in FIG. 10B, the tapered sections can extend generally vertically along an interior area of the opposing shoulders 192. As shown in FIG. 10C, in some embodiments, the tapered sections 240 can be generally flat and can extend generally perpendicularly from a perimeter 250 of a center 252 of the second runner 154.

In accordance with other embodiments, the opposing shoulders 192 can include recesses 260 for accommodating distal ends of the ribs connected thereto. The recesses 260 preferably correspond to the width of the ribs received therein. Furthermore, the recesses 260 should further be configured to allow the distal end of the rib to pivot with respect to the pin. It is also contemplated that embodiments can be provided wherein the distal ends of the rib can be shaped as fork members whereinto the opposing shoulders 192 can be pivotably coupled.

Furthermore, as shown in FIG. 10C, the second runner 154 can also include a guide 270 for coupling the second runner 154 to the pole of the umbrella. In some embodiments, the guide 270 can be used to generally fix at least one of the vertical or rotational orientations of the second runner 154 relative to the pole. For example, as discussed above, some embodiments of the umbrella can be configured such that the second runner 154 is fixed relative to the pole. Alternatively, the guide 270 could be used to effectuate movement of the second runner 154 therealong.

As shown in the embodiment of FIG. 10C, the guide 270 can be configured as a T-shaped member and can optionally include a connection aperture 272. The connection aperture 272 can be configured to receive a screw, bolt, a vertical rod, or other structure to secure the guide 270 to within the pole of the umbrella. As such, depending on the configuration of the pole, which may include a longitudinal slot or an aperture through which the guide 270 can be received, and further depending on whether the second runner 154 is fixed, the attachment means can fix the longitudinal position and/or the rotational position of the second runner 154 relative to the pole.

Figure 11A:
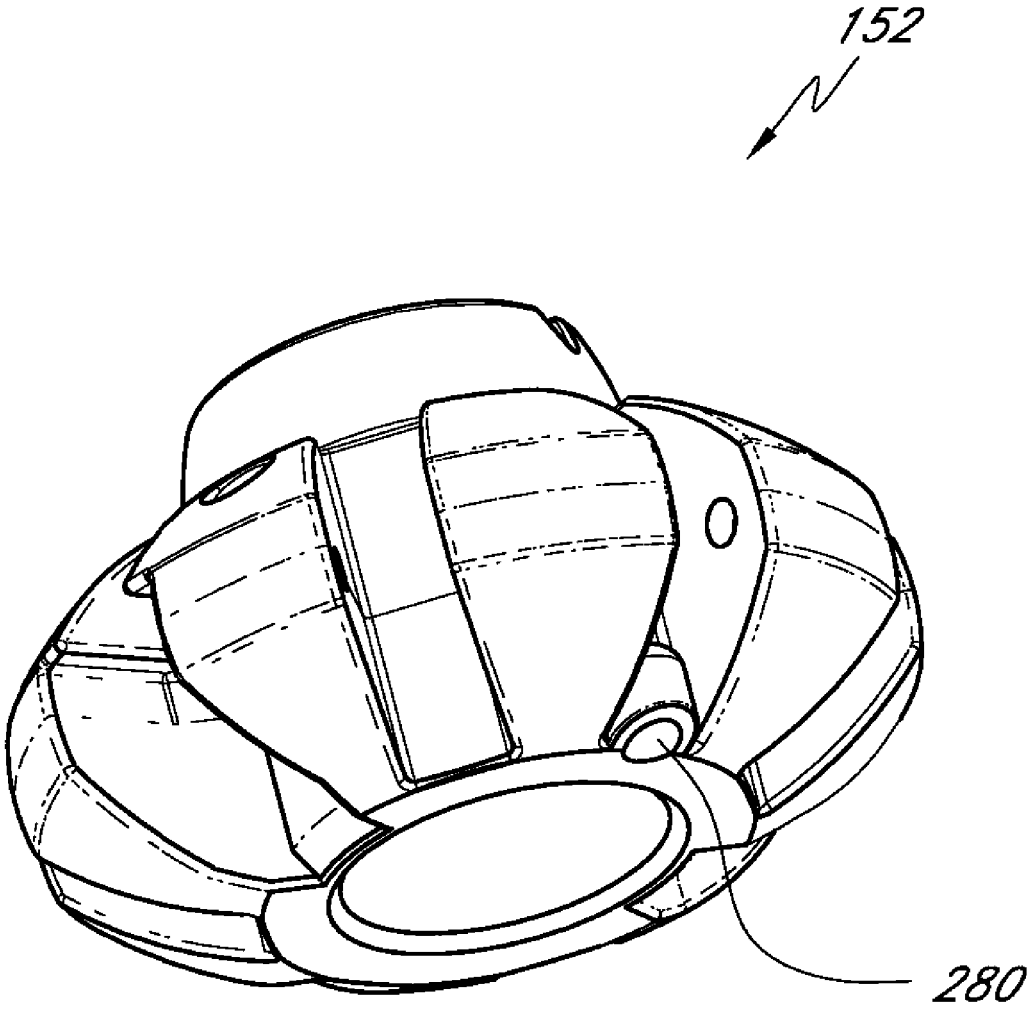
FIG. 11A is a top perspective view of the first runner of the hub shown in FIG. 8.
Figure 11B:
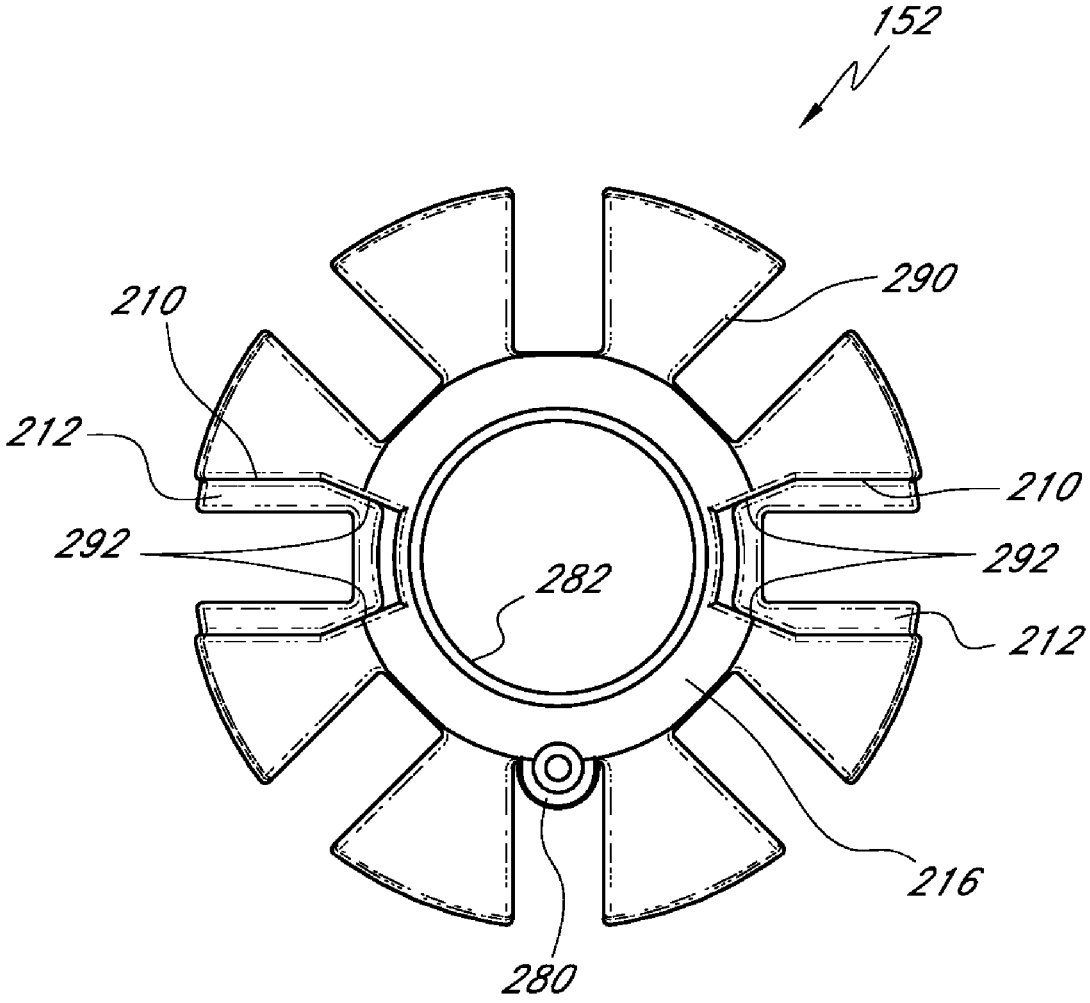
FIG. 11B is a top view of the first runner shown in FIG. 11A.

Referring now to FIGS. 11A-B, an exemplary embodiment of the first runner 152, as illustrated in FIG. 8, is shown. The first runner 152 can include a coupling aperture 280. The coupling aperture 280 can be disposed adjacent the inner perimeter of the first runner 152. As such, as described above, when the first runner 152 slides relative to the pole, the coupling aperture 280 can be used to receive a guide pole or rod that can be used to maintain the relative axial orientation of the first runner 152 relative to that of the pole to maintain the relative axial or rotational orientation substantially constant relative to that of the pole. However, in other embodiments, it is contemplated that the inner perimeter 282 can include a guide such as that illustrated with respect to the second runner 154 or other means in order to maintain the structural rigidity and alignment of the first runner relative to the pole.

As shown best in FIG. 11B, the bottom view of the first runner 152 illustrates that the nesting cavity 210 can tend to be larger than rib connection cavities 290 in order to accommodate the size of the opposing shoulders 192. Further, the nesting cavities 210 can also include tapered sections 292 configured and corresponding to the tapered sections 240 of the second runner 154. Further, as discussed above, with respect to FIG. 9, the opposing abutments 212 and the lower surface 216 preferably include a sufficient surface area to mate with the respective ones of the top surfaces 214 and the upper surface 218 of the second runner 154. In such embodiments, the configuration of the opposing abutments 212, the opposing shoulders 192, and the general configuration of the top and bottom mating areas of the first and second runners 152, 154 can tend to reduce stress concentrations in any portion of the first and second runners 152, 154.

Now, according to a first embodiment and operation of embodiments discussed herein, the umbrella 10 can be configured to include only the first actuating handle 70. The first actuating handle 70, as taught herein, can be utilized to move the canopy support frame 14 from the closed position 60 to the open position 62. In such an embodiment, the first actuating handle 70 can be vertically translatable along the first elongate channel 20, and in response to the vertical translation of the first actuating handle 70, at least the first hub 30 can experience a corresponding vertical translation in order to move the canopy support frame 14 from the closed position 60 to the open position 62.

According to a second embodiment and operation of the present invention, the umbrella 10 can include both the first and second actuating handles 70, 72. In such an embodiment, vertical displacement of the first actuating handle 70 can cause a corresponding vertical translation of the first hub 30 to move the canopy support frame 14 from a closed position 60 to an open position 62. Further, vertical translation of the second actuating handle 72 can cause a corresponding vertical translation of the second hub 32 in order to move the canopy support frame 14 from the open position 62 to the extended position 64. The first and second actuating handles 70, 72 can travel along the lower pole 16 and be at least partially disposed within the respective ones of the first and second elongate channels 20, 74.

According to a third and preferred embodiment and operation, the umbrella 10 can comprise the first and second actuating handles 70, 72. As with the second embodiment, vertical translation of the first and second actuating handles 70, 72 can cause corresponding vertical translation of the respective ones of the first and second hubs 30, 32. However, in the third and preferred embodiment, the second hub 32 can comprise the first and second runners 152, 154. Thus, vertical translation of the second actuating handle 72 can cause relative movement between the first and second runners 152, 154. For example, the first runner 152 can rise at a faster rate than the second runner 154 during movement of the second hub 32.

The third and preferred embodiment can also include the first and second elongate members 80, 82. As mentioned above, the first elongate member 80 can be coupled to the first hub 30 and the first actuating handle 70 in order to ensure that the position of the first hub 30 is fixed relative to the position of the first actuating handle 70. Thus, downward vertical translation of the first actuating handle 70 can directly result in corresponding downward vertical translation of the first hub 30. Such exemplary movement can be made when moving the canopy support frame 14 from the closed position 60 to the open position 62.

In accordance with another aspect of the third and preferred embodiment, the second elongate member 82 can be coupled to the pulley assembly and the second hub 32. It is contemplated that the lower end 110 of the second elongate member 82 can be coupled to either the first or second runners 152, 154 of the second hub 32. However, in the third and preferred embodiment, the second elongate member 82 can be coupled with the second runner 154. Thus, the position of the pulley assembly 100 can be fixed relative to the position of the second runner 154, and allow the first runner 152 to be vertically translated along the lower pole 16 upon vertical translation of the second actuating handle 72.

Furthermore, the third and preferred embodiment can also include two strut pairs 150 which can be coupled to the second runner 154, the intermediate hub 34, and respective ones of the first plurality of ribs 40. When the first actuating handle 70 is downwardly vertically translated, the first hub 30 can be correspondingly downwardly vertically translated which can result in the expansion of the canopy support frame 14 from the closed position 60 toward the open position 62. During this expansion, the first ends 42, 54 of the first and second pluralities of ribs 40, 50 can be moved towards each other (with the second ends 44, 54 thereof moving radially outwardly) due to the coupling of the strut pair 150 with the intermediate hub 34, which can be fixedly mounted to the lower pole 16. Thus, the first hub 30 and the second hub 32 can tend to relatively converge toward each other during the movement of the canopy support frame 14 from the closed position 60 to the open position 62. Additionally, during this expansion, the position of the pulley assembly 100 can be fixed relative to the position of the second hub 32. Thus, the upward vertical translation of the second hub 32 can be at least partially limited by the size of the second elongate member 82 which can interconnect the pulley assembly 100 and the second hub 32 and the distance between the pulley assembly 100 and the intermediate hub 34. In operation, the open position 62 can be achieved once the pulley assembly 100 has been moved to a position adjacent to or just lower than the intermediate hub 34.

In the third embodiment, when the canopy support frame 14 has reached the open position 62, the second actuating handle 72 can be downwardly vertically translated in order to draw the tension member 102 through the pulley to thereby raise the first runner 152 from the nested position of the second hub 32. This movement of the first runner 152 can cause a corresponding movement of the remaining ones 160 of the second plurality of ribs 50. Such movement can cause the first plurality of ribs 40 has to be raised to the extended position 64. Finally, the first and second actuating handles 70, 72 can be fixed in position relative to the lower pole 16 using the tightening elements.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella, comprising:

a support pole assembly comprising a lower pole and an upper pole translatable relative to the lower pole, the support pole further comprising an outer surface and an elongate channel recessed in the outer surface;

a canopy support frame comprising a first hub coupled with the upper pole, a second hub disposed beneath the first hub, and a plurality of ribs, each rib having a first end coupled with the first hub and a second end disposed away from the first hub, the canopy support frame having an open position in which the second end of each of the ribs is disposed away from the support pole assembly at a first elevation;

an intermediate hub coupled with the lower pole and at least one of the plurality of ribs;

a canopy coupled with the canopy support frame and movable therewith;

an elongate member disposed in said elongate channel, the elongate member being coupled with the second hub; and an actuating handle having a portion slideably disposed within the elongate channel and coupled with the elongate member;

wherein after the canopy has been moved to the open position, the actuating handle can be movable to move the second hub to raise the second end of the ribs to a second elevation that is higher than the first elevation.

2. The umbrella of claim 1, wherein the actuating handle is movable such that the second hub can be raised until the second end of each of the ribs is at substantially the same elevation as the first hub.

3. The umbrella of claim 1, wherein the actuating handle comprises a plurality of actuating handles, wherein one of the plurality of actuating handles is coupled with the first hub, and the upper pole is translatable relative to the lower pole so that when the actuating handle coupled with the first hub is lowered, the upper pole and the first hub are lowered causing the canopy support frame to move from a closed position to the open position.

4. An umbrella, comprising:

a support pole assembly comprising a lower pole, an upper pole translatable relative to the lower pole, a first elongate channel and a second elongate channel;

a canopy support frame comprising a first hub coupled with the upper pole and with a plurality of ribs and a second hub coupled with the ribs and disposed below the first hub;

a first actuating handle configured to translate within the first elongate channel to move the upper pole relative to the lower pole to open and close the canopy support frame; and a second actuating handle configured to translate within the second elongate channel to alter the configuration of the canopy by applying an upward force from above the second hub.

5. The umbrella of claim 4, wherein at least one of the first and second actuating handles is coupled with the support pole assembly for translation along an axis approximately parallel to a longitudinal axis of the support pole assembly.

6. The umbrella of claim 4, further comprising an elongate member having a lower end coupled with the first actuating handle and an upper end coupled with the first hub such that vertical movement of the first actuating handle is transferred through the elongate member to the first hub causing vertical movement of the first hub.

7. The umbrella of claim 6, wherein the elongate member is a first elongate member and the umbrella further comprises a second elongate member having a first end coupled with the second actuating handle and a second end coupled with the second hub such that vertical movement of the second actuating handle is transferred through the elongate member to the second hub causing vertical movement of the second hub.

8. The umbrella of claim 4, further comprising an elongate member having a lower end coupled with the second actuating handle and an upper portion coupled with the second hub such that vertical movement of the second actuating handle is transferred through the elongate member to the second hub causing vertical movement of the second hub.

9. The umbrella of claim 4, further comprising at least one roller positioned between at least one of the first actuating handle or the second actuating handle and one of the first hub or the second hub.

10. The umbrella of claim 4, further comprising an intermediate hub coupled with the lower pole and with the ribs.

11. The umbrella of claim 10, wherein the intermediate hub maintains a constant elevation as the first hub is raised.

12. The umbrella of claim 10, wherein said plurality of ribs comprises a canopy rib coupled with the first hub and with the canopy, a first member pivotably coupled with the canopy rib and with the second hub, and a second member pivotably coupled with the intermediate hub and the first member.

13. The umbrella of claim 4, further comprising a pulley assembly having a cord that extends between the second actuating handle and the second hub such that the second actuating handle can be moved to alter the configuration of the canopy.

14. The umbrella of claim 4, wherein moving the first actuating handle downwardly causes the first hub to move downwardly, and moving the second actuating handle downwardly causes the second hub to move upwardly.

15. The umbrella of claim 4, wherein the first actuating handle moves downwardly to move the canopy support frame to an open position in which ends of the ribs are disposed away from the support pole at a first elevation, and wherein the second actuating handle moves downwardly to move the ends of the ribs to a second elevation that is higher than the first elevation.

16. An umbrella, comprising:

a support pole assembly comprising a lower portion having an outer surface and an elongate channel recessed in the outer surface;

a canopy support frame comprising a first hub coupled with an upper portion of the support pole assembly and with a plurality of ribs and a second hub disposed beneath the first hub and coupled with the plurality of ribs;

a canopy coupled with the canopy support frame and movable therewith;

an actuating handle; and an elongate member coupled with the second hub and with the actuating handle, the elongate member and at least a portion of the actuating handle being disposed in the elongate channel, the elongate member comprising a tension member that extends from the actuating handle to an intermediate elevation above the second hub and from the intermediate elevation to an upper surface of the second hub;

wherein after the canopy has been moved to an open position, the actuating handle and the elongate member can be moved in the elongate channel to move the second hub to alter the configuration of the canopy.

17. An umbrella, comprising:

a support pole;

a first hub attached to the support pole and having a first plurality of ribs extending from the hub, the ribs supporting a canopy and being movable from a stowed position in which the canopy is substantially closed to an extended position in which the canopy is substantially open;

at least one additional hub extending around the support pole at a location below the first hub, the additional hub comprising:

a first hub component having a second plurality of ribs extending therefrom; and a second hub component having a third plurality of ribs extending therefrom;

wherein the first and second hub components are movable with respect to each other from a position in which they are nested or embedded together to another position in which they are separated, wherein the first and second hub components are nested when the canopy is substantially closed, and the first and second hub components are separated when the canopy is in an open state;

an actuating handle; and an elongate member disposed in an elongate channel, the elongate member being coupled with the first hub component of the at least one additional hub;

wherein the actuating handle can be movable to move the first hub component of the second hub to alter the configuration of the canopy.

18. The umbrella of claim 17, wherein the second and third plurality of ribs are connected to their respective hub components by connectors that permit the ribs to pivot about a pivot point and where the pivot points of the ribs of the first hub component and second hub component be in substantially the same place when the hub components are nested or embedded together.

19. The umbrella of claim 17, wherein each of the first and second hub components have at least one projection element and at least one recess, so that the first and second hub components can be nested or embedded together by interaction of the respective projection(s) and recess(es).

20. The umbrella of claim 17, wherein the first hub component is in the upper position with respect to the second hub component when the umbrella is erected and the first hub component has more ribs than the second hub component.

21. The umbrella of claim 20, wherein the first hub component has four ribs and the second hub component has two ribs.

22. An umbrella comprising:

a pole having an upper hub having a plurality of ribs extending therefrom to support a fabric canopy thereon;

the pole having a longitudinal axis and at least a first channel and a second channel, wherein the first channel and the second channel are formed in the outer surface of the pole and extend substantially parallel to the longitudinal axis thereof;

at least a first actuator and a second actuator, wherein the first actuator is slideably moveable in the first channel to effectuate a first change in the configuration of the canopy, and the second actuator is slideably movable in the second channel to effectuate a second change in the configuration of the canopy;

whereby lowering the first actuator in the first channel causes the canopy to open; and raising the second actuator in the second channel cause the canopy to change its shape.

23. The umbrella of claim 22, wherein raising and lowering the first actuator causes the umbrella canopy to open and close and raising and lowering the second actuator causes every other rib to be raised with respect to adjacent ribs.

24. An umbrella, comprising:

a support pole assembly comprising a lower portion having an outer surface and an elongate channel recessed in the outer surface;

a canopy support frame comprising a first hub coupled with an upper portion of the support pole assembly and with a plurality of ribs and a second hub disposed beneath the first hub and coupled with the plurality of ribs, wherein the second hub comprises a first portion that is fixedly attached to the support pole assembly and a second portion that can be raised relative to the first portion;

a canopy coupled with the canopy support frame and movable therewith;

an actuating handle; and an elongate member coupled with the second hub and with the actuating handle, the elongate member and at least a portion of the actuating handle being disposed in the elongate channel, wherein after the canopy has been moved to an open position, the actuating handle and the elongate member can be moved in the elongate channel to move the second hub to alter the configuration of the canopy.

25. An umbrella, comprising:

a support pole assembly including a lower pole, an upper pole translatable relative to the lower pole, an outer surface, a first elongate channel recessed in the outer surface, a second elongate channel recessed in the outer surface, and a central recess disposed within the support pole and generally intermediate the first elongate channel and the second elongate channel;

a canopy support frame including a first hub coupled with the upper pole, a second hub disposed beneath the first hub, and a plurality of ribs, each of the plurality of ribs having a first end coupled with the first hub and a second end disposed away from the first hub, the canopy support frame having an open position in which the second end of each of the ribs is disposed away from the support pole assembly at a first elevation;

a canopy coupled with the canopy support frame and movable therewith;

a first elongate member disposed in said first elongate channel and coupled with the first hub;

a first actuating handle having a portion slideably disposed within the first elongate channel, the first actuating handle being coupled with the first elongate member, and operable to move the canopy between a closed position and the open position;

a second elongate member disposed in said second elongate channel and coupled with the second hub;

a second actuating handle at least partially slideably disposed within the second elongate channel, and the second actuating handle being coupled with the second elongate member, wherein after the canopy has been moved to the open position, the second actuating handle can be movable to move the second hub to raise the second end of each of the plurality of ribs to a second elevation that is higher than the first elevation.

* * * * *

UNITED STATES PATENT AND TRADEMARK OFFICE

CERTIFICATE OF CORRECTION

PATENT NO. : 7,798,161 B2
APPLICATION NO. : 11/850628
DATED : September 21, 2010
INVENTOR(S) : Oliver Joen-an Ma It is certified that error appears in the above-identified patent and that said Letters Patent is hereby corrected as shown below:

In Column 3, Line 17, change "position" to "position;".

In Column 3, Lines 57-67, change "According to an implementation of the present invention, the first elongate member 80 can define an upper end 81 and a lower end 84. The lower end 84 of the first elongate member 80 can be coupled with the first actuating handle 70, and the upper end 81 of the first elongate member 80 can be coupled to the first hub 30. The first elongate member 80 can be made of a variety of materials, such as metal, plastic, and can be elastic or inelastic. However, in a preferred embodiment, the first elongate member 80 can be fabricated from a substantially rigid material such that a position of the first hub 30 can be fixed relative to a position of the first actuating handle 70."

to --According to an embodiment illustrated in FIG. 1, the umbrella 10 can include a support pole assembly 12. The support pole assembly 12 can be configured to include at least one pole, and preferably comprises a lower pole 16 and an upper pole 18. The upper pole 18 can be translatable relative to the lower pole 16. In addition, the lower pole 16 can be configured to include at least one first elongate channel 20. Although it is contemplated that the first elongate channel 20 can be formed separately from the lower pole 16, the elongate channel 20 can be at least partially recessed in an outer surface 22 of the lower pole 16, as shown in FIGS. 1,4, and 5.--.

In Column 5, Line 27, change "82" to --81--.

In Column 5, Line 30, change "82" to --81--.

Signed and Sealed this
Twenty-ninth Day of March, 2011

David J. Kappos

David J. Kappos
*Director of the United States Patent and Trademark Office*